US006189776B1

(12) United States Patent
Smith et al.

(10) Patent No.: US 6,189,776 B1
(45) Date of Patent: Feb. 20, 2001

(54) NESTED BOX WITH INTEGRATED LID AND/OR SUPPORT STRUCTURE FOR HANGING FILES

(75) Inventors: Jeffrey A. Smith, Clark; Richard N. Beneroff, Chatham; Eric Kim, Secaucus, all of NJ (US)

(73) Assignee: Motion Design, Inc., Linden, NJ (US)

( * ) Notice: Under 35 U.S.C. 154(b), the term of this patent shall be extended for 0 days.

(21) Appl. No.: 09/277,300

(22) Filed: Mar. 26, 1999

(51) Int. Cl.[7] ..... B65D 5/06

(52) U.S. Cl. ..... 229/117; 206/425; 229/185.1; 312/184

(58) Field of Search ..... 229/117, 122, 229/164, 185.1; 206/214, 215, 425; 312/183, 184; 220/FOR 128

(56) References Cited

U.S. PATENT DOCUMENTS

| | | | | |
|---|---|---|---|---|
| Re. 33,953 | | 6/1992 | Everts | 312/184 |
| 460,817 | | 10/1891 | Clark | 229/139 |
| 1,928,660 | | 10/1933 | Boeye | 229/127 |
| 2,284,815 | | 6/1942 | Grimm | 229/120.08 |
| 2,307,913 | | 1/1943 | Bergstein | 229/139 |
| 2,327,709 | | 8/1943 | Himes . | |
| 2,577,588 | | 12/1951 | Paige . | |
| 2,843,308 | | 7/1958 | Paige . | |
| 3,278,108 | | 10/1966 | Paige . | |
| 3,361,326 | | 1/1968 | Croley | 229/192 |
| 3,430,840 | | 3/1969 | Paige . | |
| 3,645,437 | | 2/1972 | Giebel et al. . | |
| 3,724,920 | | 4/1973 | Beck | 312/184 |
| 3,748,008 | * | 7/1973 | Pryor | 312/184 |
| 3,780,932 | | 12/1973 | McLaren et al. . | |
| 3,801,001 | | 4/1974 | Taylor | 229/139 |
| 3,913,824 | | 10/1975 | Paige . | |
| 3,957,320 | * | 5/1976 | Walter | 229/122 |
| 3,960,312 | | 6/1976 | Gorham . | |
| 4,182,477 | | 1/1980 | Paige . | |

(List continued on next page.)

FOREIGN PATENT DOCUMENTS

| | | | |
|---|---|---|---|
| 73698 | 9/1944 | (CS) | 229/155 |

OTHER PUBLICATIONS

"Letter–Legal Hanging File Box" product leaflet, Perma Products, Product No. 17020, with assembly instructions.
Perma Hanging File Box sheet, Product Nos. 10219 & 10249.
Fellowes Premier Line brochure showing Portable Filing System, stock #51114, 1988.
Fellowes Bankers Box brochure showing Portable File, Stock #61114, 1993.

*Primary Examiner*—Gary E. Elkins
(74) *Attorney, Agent, or Firm*—Kenyon & Kenyon

(57) ABSTRACT

The present invention provides for an improved telescoping container, which is set up and collapsed flat quickly and easily, and is provided to the user in one integral piece, eliminating the necessity of a lid being assembled or maintained separately. An integral lid provides an improved amount of cushioning and strength, and does not enter the cubic volume of the container and thus reduce available storage space. In another embodiment the collapsible container includes a structure enabling the storage of hanging files in a collapsible box. An embodiment of the present invention provides for a container with improved support structures for hanging files. The support structures provide a smooth, reinforced surface of sufficient width on which the hooks of hanging files may rest. Since the support structures are constructed from material integral with the container itself, no separate piece is required. The support structures, extending from the floor of the container and lying against the sides of the container, prevent shifting of the folders and prevent the contents of the folders from slipping out of the folders.

20 Claims, 24 Drawing Sheets

U.S. PATENT DOCUMENTS

| | | | |
|---|---|---|---|
| 4,266,715 | 5/1981 | Garrison . | |
| 4,272,009 | 6/1981 | Bamburg et al. | 229/139 |
| 4,325,493 | 4/1982 | Paige . | |
| 4,373,660 | 2/1983 | Wytko . | |
| 4,403,429 | 9/1983 | Wytko | 229/151 |
| 4,406,380 | 9/1983 | Paige . | |
| 4,795,081 | 1/1989 | Miller . | |
| 4,899,929 | 2/1990 | Grollman | 229/122.1 |
| 4,958,728 | 9/1990 | Effendi . | |
| 5,011,071 | 4/1991 | Lopez | 229/117 |
| 5,190,152 | 3/1993 | Smith et al. | 206/425 |
| 5,193,701 | 3/1993 | Bush et al. | 220/4.33 |
| 5,275,331 | 1/1994 | Chung-Piao | 229/117.15 |
| 5,494,161 | 2/1996 | Herbst | 206/425 |
| 5,579,989 | 12/1996 | Roy et al. | 229/110 |
| 5,842,570 | 12/1998 | Turnbull | 206/425 |
| 6,016,952 * | 1/2000 | Smith et al. | 229/185.1 |

* cited by examiner

NESTED BOX WITH INTEGRATED LID AND/OR SUPPORT STRUCTURE FOR HANGING FILES

BACKGROUND OF THE INVENTION

The present invention relates to a nested container which is set up from and returns to a flat condition quickly and easily. More specifically, the present invention relates to a container which is easily set up and collapsed, and which may be provided with an integral lid or may be used to store hanging files.

Nested containers which are set up from and returned to a flat condition quickly and easily, for example by telescoping an inner portion into an outer portion, are known. An example of such a container is shown in U.S. Pat. No. 2,577,588, which is expressly incorporated by reference herein. During set up, panels which connect the inner and outer portions collapse and fold to form the bottom of the container.

While such prior art containers are convenient, a separate lid must be stored and assembled to complete the container. Furthermore, existing lids often do not provide enough cushioning or strength, and may enter the cubic volume of the container and thus reduce available storage space. In addition, while such containers gain strength from having a double walled construction, improvements to their strength can be made.

In the prior art, when it has been desired to allow hanging files or folders to be stored in a container, parallel support structures or support areas have been provided along the top edges of two parallel side panels of the container. (When used herein, "hanging file" and "hanging folder"are used interchangeably.) Each hanging file may have suspension hooks (or "rails") at its top which fit over the support structures; the file hangs down from these hooks. The suspension hooks rest on and are supported by the support structures. Current containers for storing hanging files require one or more separate pieces to support the files. Such prior art hanging file containers require a certain amount of setup time since the separate pieces must be separately manufactured and later combined.

SUMMARY OF THE INVENTION

It is therefore desirable to have an easily set up and collapsible container which has a lid which is integral to the container so that users do not have to maintain a separate stock of lids or assemble a separate piece to complete the container. It is desirable to provide such a container with an easily closed lid which provides an improved amount of cushioning and strength, and which will not enter the cubic volume of the container and thus reduce available storage space. It is further desirable to have a container with more strength than existing telescoping double walled containers.

It is desirable to have an easily set up and collapsible container which may store hanging files. There is a need for a container with integral support structures for hanging files, wherein the support structures provide a support area (the portion of the support structure in contact with hanging file rails) with a smooth surface, having sufficient width, and having sufficient reinforcement and structural support, and where the support structures do not require a separate piece or separate assembly. There is a need for support structures which have a simple, strong construction, and which prevent shifting of folders held within the container and prevent the contents of the folders from slipping out of the folders.

The present invention provides for an improved telescoping container, which sets up and collapses quickly and easily, and is provided to the user in one integral piece, eliminating the necessity of a lid being assembled or maintained separately. The container is set up by having an inner portion telescope into an outer portion, and may be collapsed by pulling the inner portion back out of the outer portion. When closed, the lid keeps the inner portion in place and thus adds to the strength of the container. In some embodiments of the invention, the ease of set up may be further improved by forming the lid from a continuous sheet of material, so that the lid may be closed in one motion, rather than the sequence of steps required with other lids. The lid may be composed of multiple layers connected by folds which act as springs, thus providing a springed, cushioned barrier to protect the contents of the container. In some embodiments of the invention, the lid may utilize flaps which add to the strength of the container. Furthermore, in some embodiments of the invention, no portion of the lid enters the cubic volume of the container, which would reduce the storage space available.

The present invention may additionally or alternatively provide for an improved telescoping container that includes a structure enabling storage of hanging files. The container sets up and collapses quickly and easily, is provided to the user in one integral piece, and, if desired, eliminates the necessity of a separate lid being assembled or maintained. The portion which provides support for hanging files is integral to the container, and does not need to be stored separately or assembled, or to be combined with the container. The entire container, including the portion supporting the hanging files, assembles by the user pressing down in essentially one movement. The container may have various forms of a lid as provided with other embodiments of the present invention; the lid may be integral to the container, may assemble quickly and easily in the same motion that assembles the container, may add to the strength of the container, and may provide a cushioned barrier to protect the contents of the container.

An embodiment of the present invention provides for a container with support structures capable of supporting hanging files, where the support area of the support structures provides a smooth, reinforced surface of sufficient width on which the hooks of hanging files may rest. These benefits are achieved without the need for separate pieces. The support structures may be formed from material integral with the container itself. The support structure is formed from upwardly extending support panels, which extend from the floor of the container. The support areas, the areas in contact with the hanging file hooks, may be located at the tops of such support panels. The upwardly extending support panels may lack score lines. In such an embodiment the upwardly extending support panels have more strength than support panels having score lines. The support structures hug the sides of the container, preventing shifting of the folders and preventing the contents of the folders from slipping out of the folders. The container may be manufactured with a double glued seam by having opposing edges sealed to one another with two tabs, each sealed to an edge. This provides the container with greater strength, in addition to that provided by the double walled construction and lid. In some embodiments two such tabs are provided but only one is glued. In either case—i.e., when both tabs are glued or when only one tab is glued—the overlapping corner provides extra strength and durability, particularly in the corners of the box, where boxes are susceptible to bursting. The tabs forming the overlapping corner also may assist in the manufacture of the piece, in that the tabs may allow for the piece to be easily gripped and manipulated during manufacturing. Other structures may be so used to provide better gripping or handling during manufacturing.

The container is intended to be cut from stock material and glued at a manufacturer's facility and shipped flat to the user, who erects the container.

BRIEF DESCRIPTION OF THE DRAWINGS

Embodiments of the invention are illustrated by way of example in the accompanying drawings.

DETAILED DESCRIPTION

I. Manufacture of the Container

Figure 1:
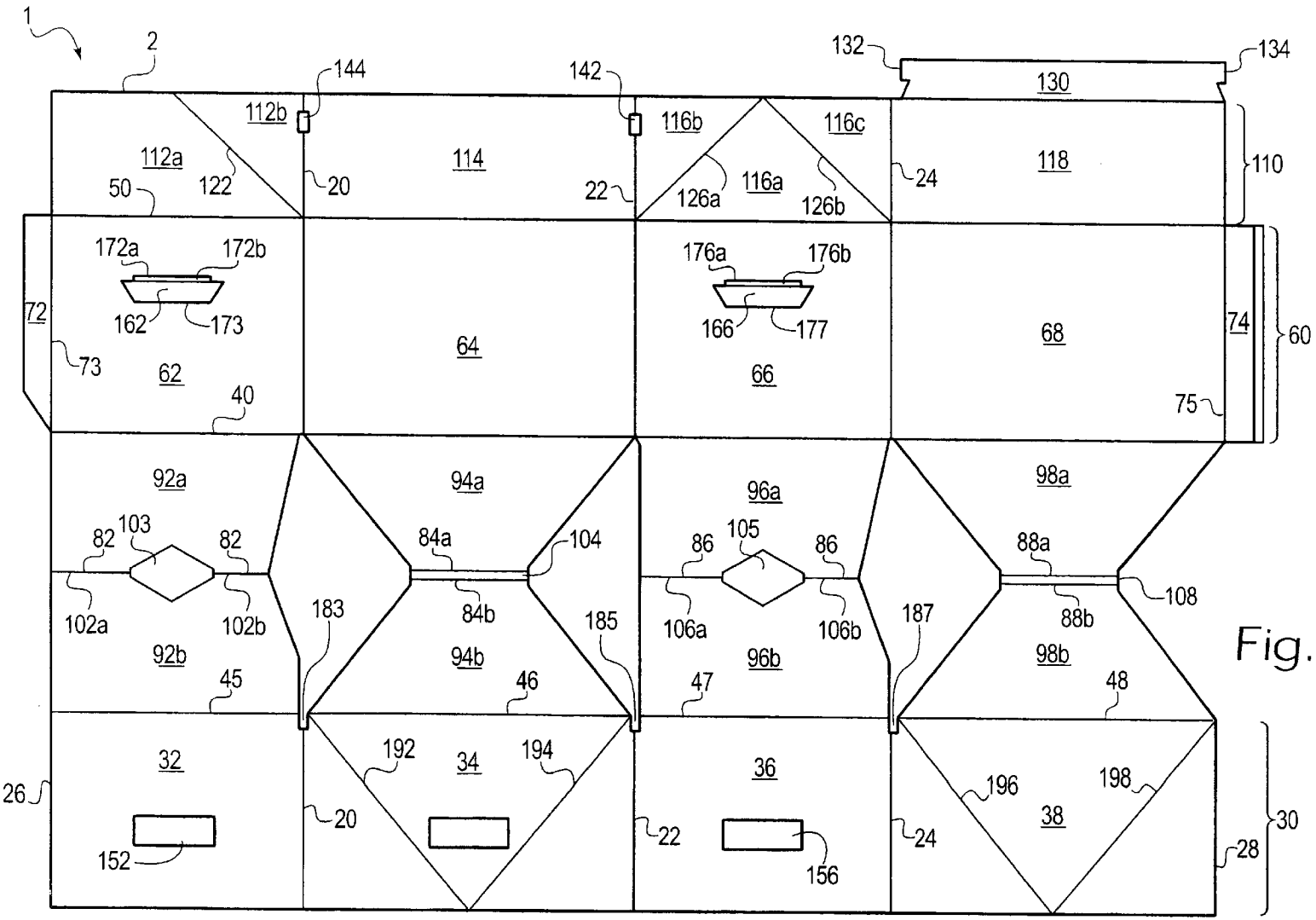
FIG. 1 shows an embodiment of a sheet of material used to form a container according to the present invention, after the sheet of material has been cut from stock material, but before the cut material is folded and glued and ready for shipping.
Figure 2:
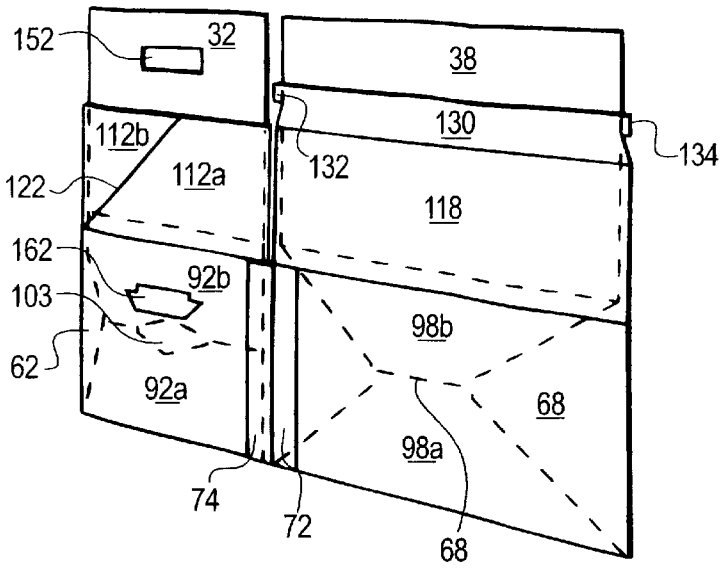
FIG. 2 shows a container formed from the sheet of FIG. 1, after the container has been fully manufactured, folded flat, and ready for shipment to the user.

Referring to FIG. 1, an embodiment of the present invention is described. A container according to an embodiment of the invention is formed from an integral sheet of material 1, preferably corrugated cardboard or chipboard. The material is cut using known methods to form cut sheet 2. To form the manufactured but not fully assembled container (as shown in FIG. 2), sheet 2 is folded along score line 40, then further folded along score lines 20 and 24. Edges 26 and 28 are coupled by fastening tab 72 to the portion of side panel 68 near edge 28 and fastening tab 74 to the portion of side panel 62 near edge 26. In an exemplary embodiment, edges 26 and 28 do not touch, but are hingedly coupled by tabs 72 and 74; in another embodiment edges 26 and 28 touch. In still another embodiment of the present invention tab 74 is glued but tab 72 is not glued. In another embodiment of the present invention edges 26 and 28 may be coupled by one rather than two tabs.

Tabs 72 and 74 are fastened to panels 68 and 62 by glue, for example adhesives or cohesives. If tabs 72 and 74 are fastened by cohesives, one cohesive element may be applied to tabs 72 and 74 and another cohesive element may be applied to panels 68 and 62. This fastening can also be achieved by, for example, tape, heat or mechanical fasteners such as staples. By fastening two tabs to opposing side panels the container is given greater strength and durability, particularly in the corners, where boxes are susceptible to bursting. It will be appreciated that the inventive reinforced corner need not be used with the nested box depicted, but it may be used with any other suitable box design or article of manufacture.

The fully manufactured but not fully set up container according to this embodiment is shown in FIG. 2. The container as shown in FIG. 2 is able to be both shipped to the user and stored in a flat form. The user may then set up the container, and also may knock down the container back to its flat form after its use.

II. Set Up of the Container

Figure 8:
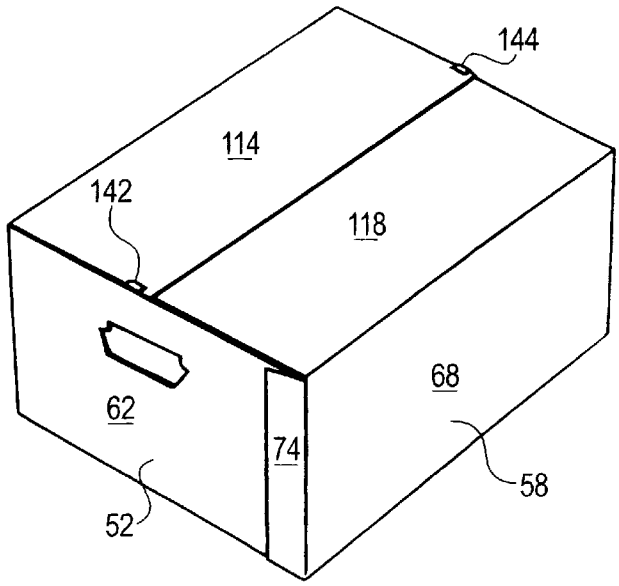
FIG. 8 shows the container of FIG. 2 fully assembled, with the lid closed.
Figure 3:
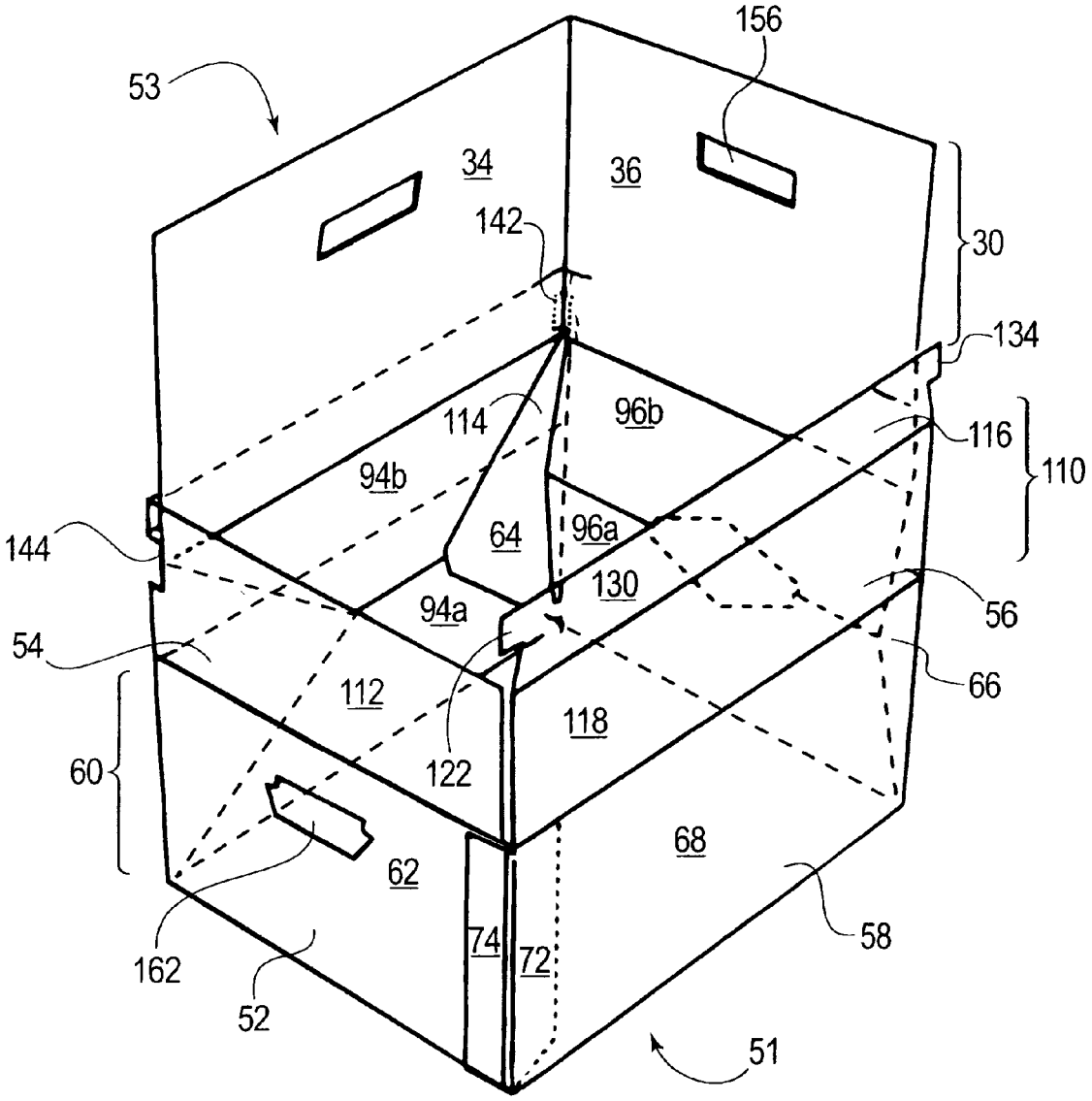
FIG. 3 shows a cutaway view of the container of FIG. 2 after the user has squared the box but before the box is telescoped to full set up.

Set up of a container from the collapsed flat condition as depicted in FIG. 2 into the fully erected container of FIG. 8 is depicted in FIGS. 3–7. The user will first expand the flat manufactured container of FIG. 2 into a rectangular parallelepiped box, pivoting sides 52, 54, 56 and 58 along score lines 73, 20, 22, 24 and 75, as shown by the cutaway view of the container in FIG. 3. With reference to FIG. 3, the box has four elongated rectangular sides 52, 54, 56 and 58, opposite panels having equal width, and two open ends 51 and 53, the ends in this example being rectangular. Inner portion 30, comprised of panels 32, 34, 36 and 38, is ready to telescope into outer portion 60, comprised of panels 62, 64, 66 and 68. After inner portion 30 telescopes into the outer portion 60, panels 92*a*, 92*b*, 94*a*, 94*b*, 96*a*, 96*b*, 98*a* and 98*b* will join to form the bottom, and panels 112, 114, 116 and 118 will form lid 110.

Figure 4:
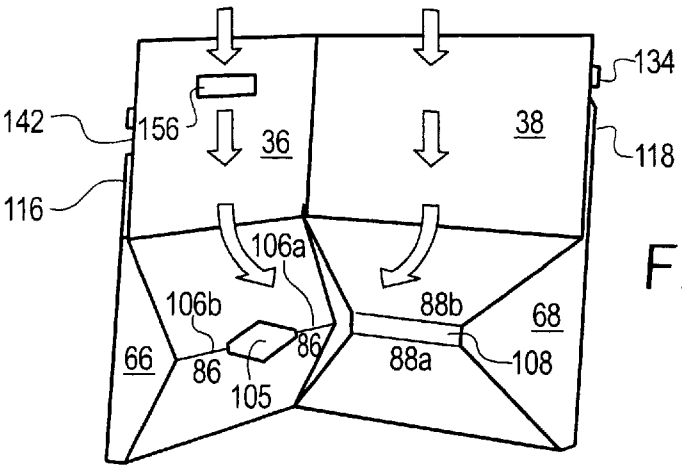
FIG. 4 shows a cutaway view of the container of FIG. 2 with the inner portion being telescoped into the outer portion.

As shown with respect to FIG. 4, the user further sets up the box by pressing down on inner portion 30, compressing bottom panels 92*a*, 92*b*, 94*a*, 94*b*, 96*a*, 96*b*, 98*a* and 98*b* and causing bottom panels 92*a*, 92*b*, 94*a*, 94*b*, 96*a*, 96*b*, 98*a* and 98*b* to fold along respective score lines 82, 84, 86 and 88, respective score lines 45–48 and score line 40. In one embodiment, score line 88 is composed of two score lines 88*a* and 88*b*, and score line 84 is composed of two score lines 84*a* and 84*b*. Gaps 183, 185 and 187 allow the lower portion of the inner portion 30 to compress to enter outer portion 60. Score lines 192, 194, 196 and 198, shown in FIG. 1, enable side panels 34 and 38 to compress slightly to allow inner portion 30 to enter outer portion 60. In addition, panel 32 has a slightly smaller width than panel 62, further enabling inner portion 30 to enter outer portion 60.

Prior art telescoping containers achieved a narrowing of the inner portion by creating the flat sheet used to form the container in an ellipsoid shape, with the section creating the outer portion having an outer edge of convex shape and the section creating the inner portion having an outer edge of concave shape. Such a container cannot lie flat when glued and cannot be easily glued by machine; the container of the present invention may have edges of straight, not curved, shape, and thus can be easily glued by machine and in addition lies flat after glueing. Other prior art containers achieved inner portion narrowing by removing a significant amount of material from the corners of the inner portion, allowing inner panels to compress or slide towards one another when the inner portion entered the outer portion. Such prior art containers lacked strength, because the corners had a significant amount of material removed and did not extend substantially the full height of the panels. The container of the present invention may have inner corner edges extending the full height or substantially the full height of the inner panels, and in such a case has extra strength provided by the inner portion.

As bottom panels 92*a*, 92*b*, 94*a*, 94*b*, 96*a*, 96*b*, 98*a* and 98*b* compress, edge 102*a* of bottom panel 92, formed as a result of the fold along score line 82, and edge 106*b* of bottom panel 96, formed as a result of the fold along score line 86, slide into the area between bottom panels 98*a* and 98*b*. In like manner, edges 102*b* and 106*a* slide into the area between bottom panels 94*a* and 94*b*. Also, as the bottom panels 92*a*, 92*b*, 94*a*, 94*b*, 96*a*, 96*b*, 98*a* and 98*b* fold, edges 104 and 108 are formed and meet in the region formed by cut-out areas 103 and 105.

Figure 6:
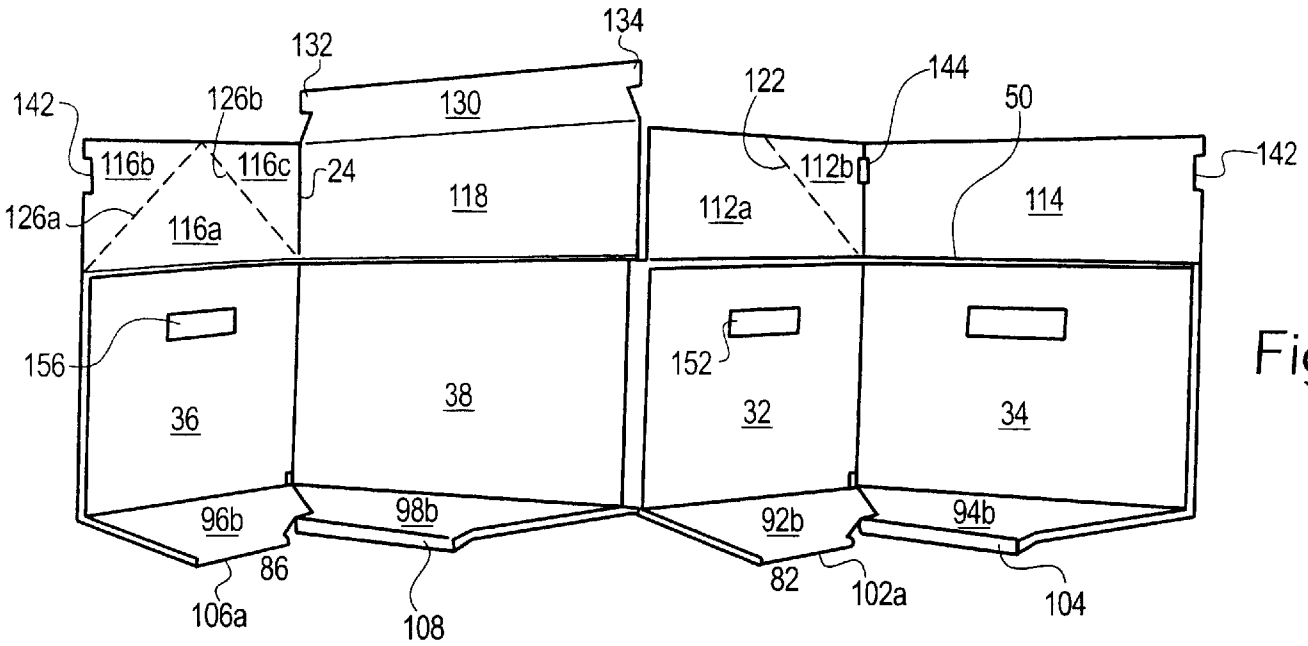
FIG. 6 shows a cutaway view of the container of FIG. 2 after the inner portion has been telescoped into the outer portion, shown opened to reveal the configuration of the panels of the container.
Figure 5:
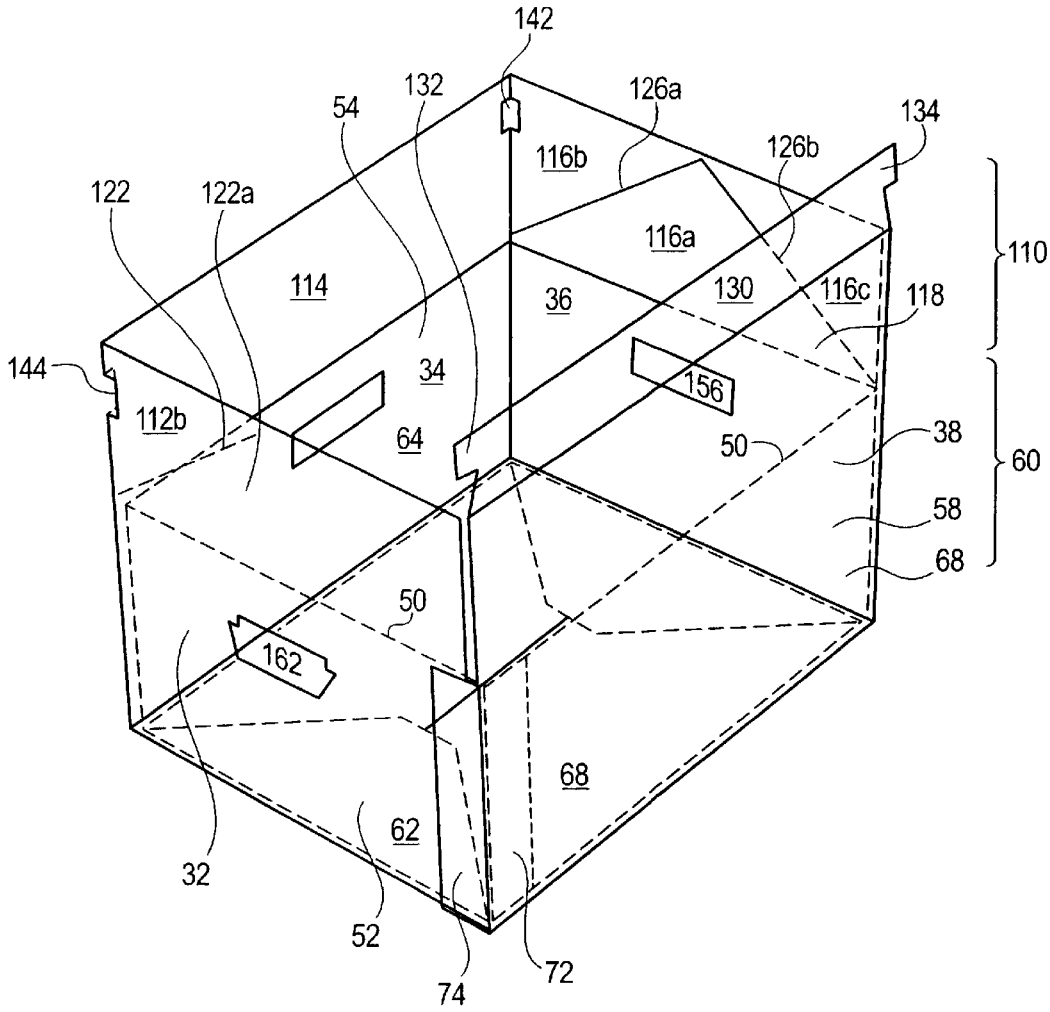
FIG. 5 shows the container of FIG. 2 after the inner portion has been telescoped into the outer portion.
Figure 5A:
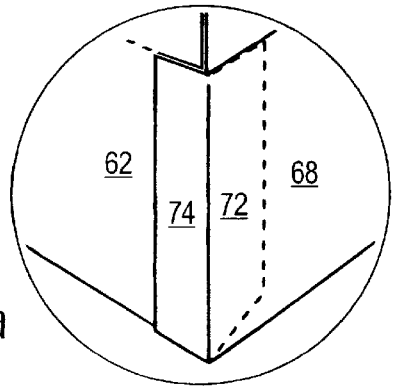

After the above described set up by the user, the container is formed, as shown in FIG. 5, as a rectangular parallelepiped box with an open top. A first side 52 is formed from panels 32 and 62, a second side 54 is formed from panels 34 and 64, a third side 56 is formed from panels 36 and 66, a fourth side 58 is formed from panels 38 and 68, and the bottom is formed by panels 92*a*, 92*b*, 94*a*, 94*b*, 96*a*, 96*b*, 98*a* and 98*b*. FIG. 6 shows a cutaway view of the container at this stage, shown opened to reveal the configuration of the panels of the container.

Figure 7:
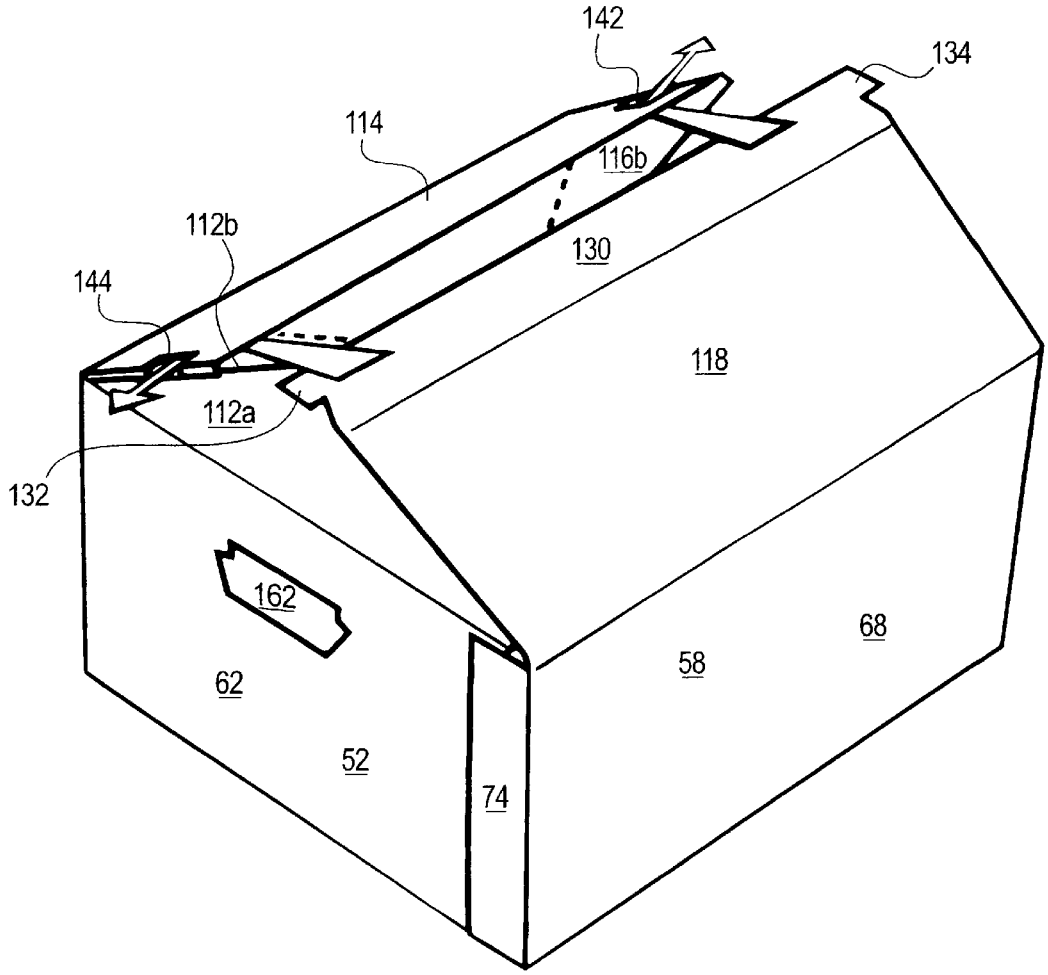
FIG. 7 shows the container of FIG. 2 fully set up, with the lid being drawn closed.

After creating the open topped container shown in FIG. 5 and typically after contents are placed in the box, the user closes lid 110, as shown in FIG. 7. In this embodiment, lid 110 is formed from panels 112, 114, 116 and 118, which comprise one continuous sheet of material extending from outer portion 60. The user folds panels 112–118 inward, panels 112 and 116 folding inward towards each other, and panels 114 and 118 folding inward towards each other. Score lines 126*a* and 126*b* allow panel section 116*a* to fold inward while panel sections 116*b* and 116*c* fold backwards to rest on top of panel section 116*a*. In like manner, score line 122 allows panel section 112*a* to fold inward while panel section 112*b* folds backwards to rest on top of panel section 112*a*. Flap 130 slides into the region created by panel section 112*b* folding back on panel section 112*a* and by panel section 116*b* folding back on panel section 116*a*. As shown in FIG. 7, to secure lid 110 in a closed position, tab 132 fits into notch 142 and tab 134 fits into notch 144.

Since in this embodiment lid 110 extends from outer portion 60, lid 110 acts to hold inner portion 30 in position and to strengthen the overall structure of the container. Lid 110 is easy to close as it is formed from a continuous sheet of material, so that the lid may be closed in one motion, rather than by the sequence of steps required with other lids. Since lid 110 is composed of three layers (e.g., portions 116*a*, 116*b*, and 114 form three layers), and because these layers are connected by folds at score lines 20, 22, 24, 122, 126*a*, and 126*b* which act as springs, lid 110 provides a springed, cushioned barrier to protect the contents of the container. Furthermore, flap 130 closes lid 110 without entering the cubic volume of the container and thus reducing the storage space available.

FIG. 8 shows the container of FIGS. 1–7 fully set up with the lid closed.

As shown with respect to FIGS. 1 and 5, tab 162 is formed from perforation 173, and folds inward along score lines 172*a* and 172*b*, through hand hole 152 to connect panel 62 to panel 32 and to maintain the form of the container. In like manner tab 166 is formed from perforation 177, and folds inward along score lines 176*a* and 176*b*, through hand hole 156. Hand holes 152 and 156 allow the container to be easily carried by providing gripping areas.

In alternate embodiments lid 110 extends from inner portion 30 rather than outer portion 60, or from both inner portion 30 and outer portion 60. In further embodiments lid 110 may be comprised of multiple panels instead of one continuous sheet, or may be attached to only one or a subset of side panels 32, 34, 36, 38, 62, 64, 66 and 68. Lid 110 may be sealed by a structure similar to that of flap 130 and tabs 132 and 134 or by other means such as glueing or stapling. In addition, in another embodiment lid 110 may not completely seal the top end of the container.

Figure 9:
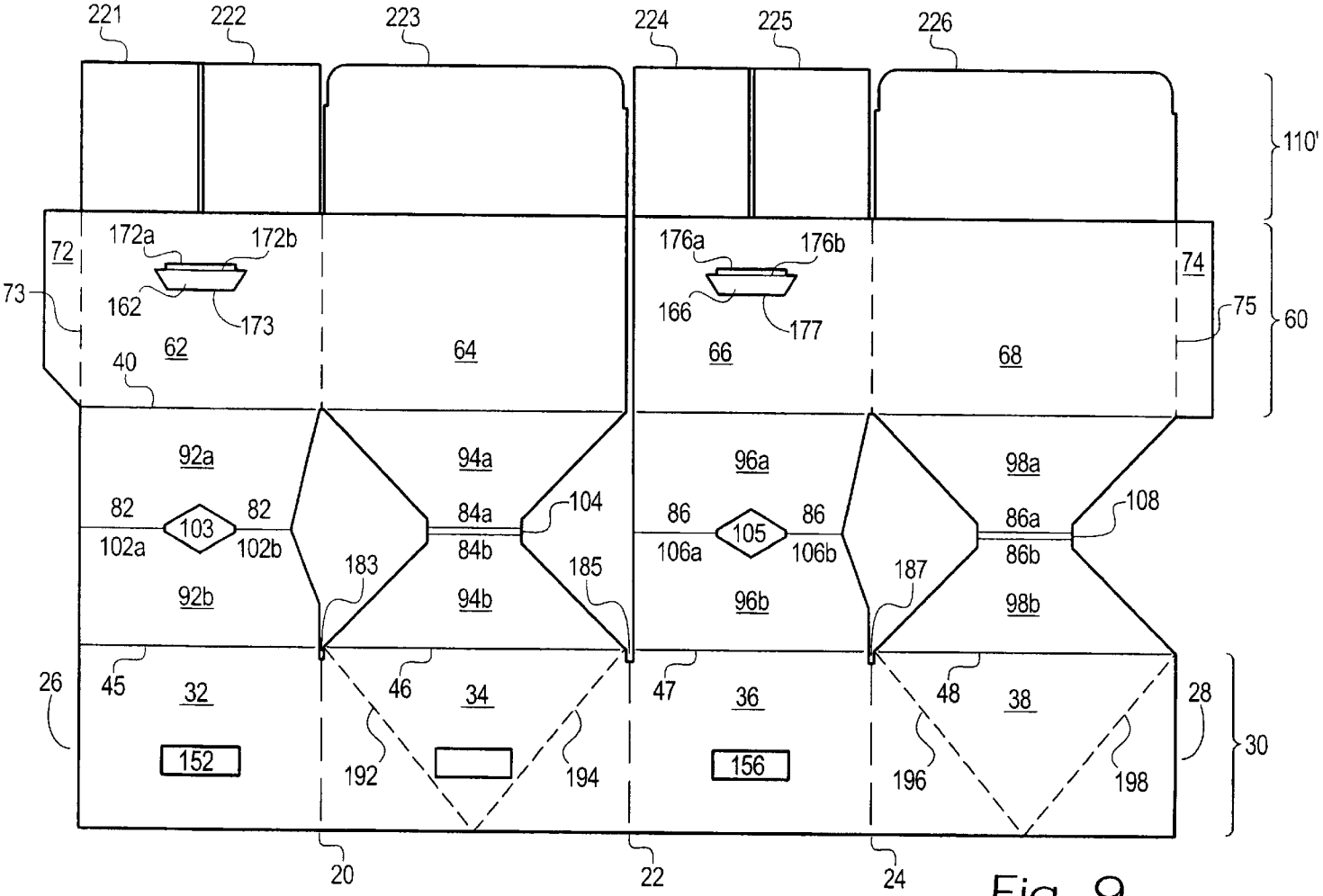
FIG. 9 shows an embodiment of a sheet of material used to from a container according to the present invention, where the lid is composed of multiple panels.
Figure 10:
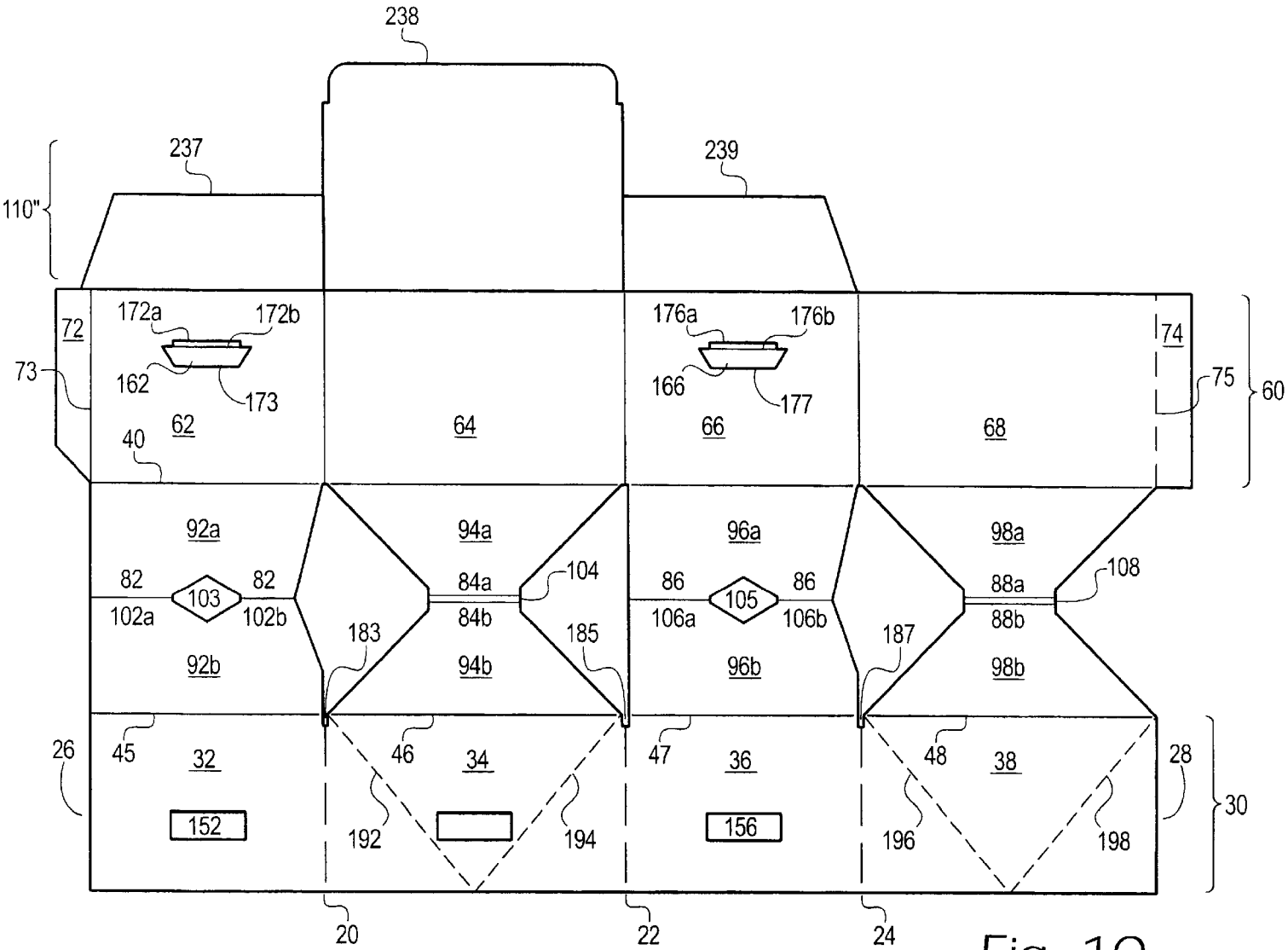
FIG. 10 shows an embodiment of a sheet of material used to form a container according to the present invention, where the lid is composed of multiple panels and is not attached to all the panels of the outer sleeve.
Figure 11:
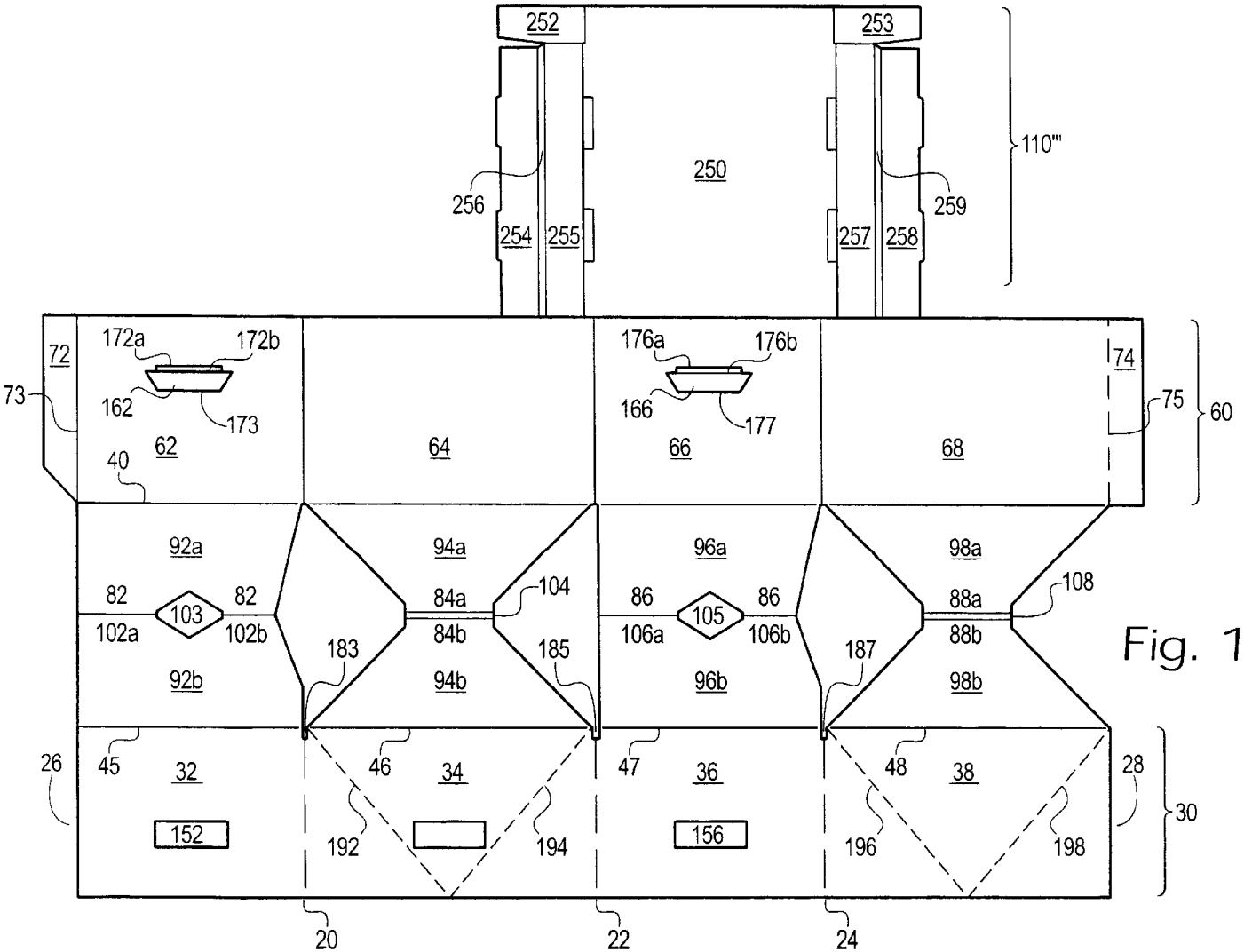
FIG. 11 shows an embodiment of a sheet of material used to form a container according to the present invention, where the lid is not attached to all the panels of the outer sleeve.
Figure 12:
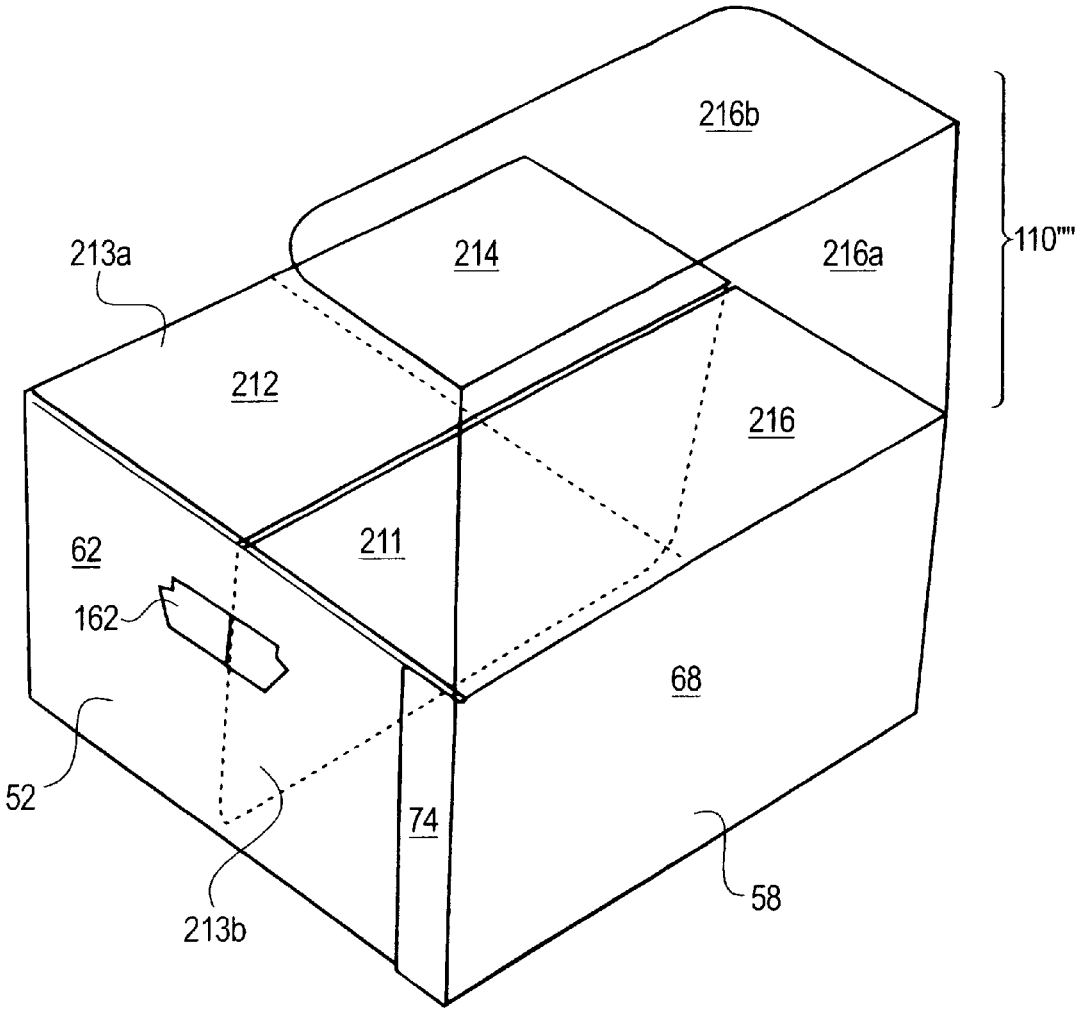
FIG. 12 shows an embodiment of the present invention where the lid is formed from multiple panels which provide a barrier to separate the contents of the container.
Figure 13:
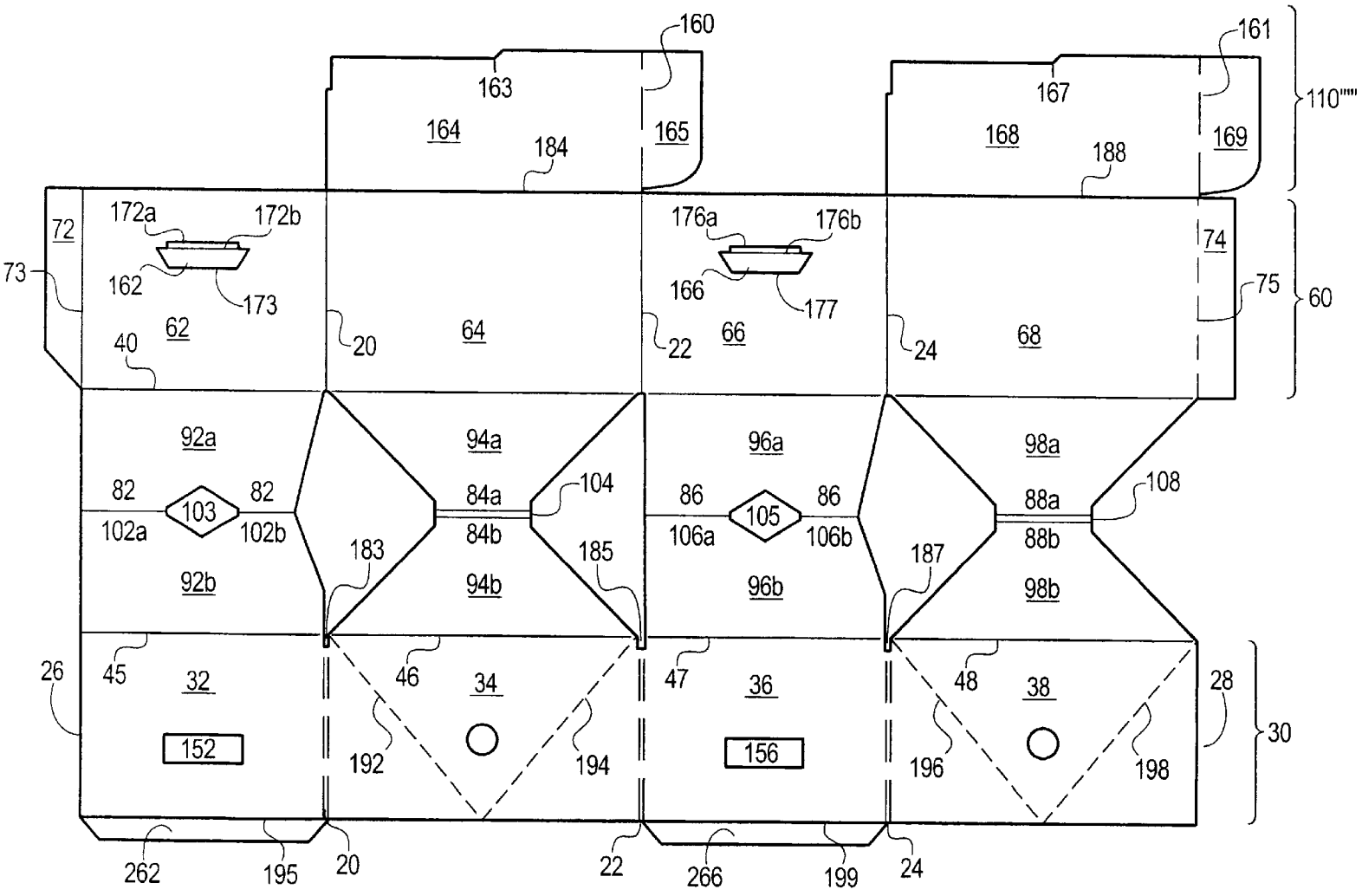
FIG. 13 shows an embodiment of a sheet of material used to from a container according to the present invention, after the sheet of material has been cut from stock material, but before the cut material is folded and glued and ready for shipping.

FIG. 9, for example, illustrates an embodiment of the present invention where lid 110' is formed from multiple panels 221–226, attached to outer portion 60. FIG. 10 depicts an embodiment of the present invention where lid 110" is formed from three panels 237–239, attached to outer portion 60. FIG. 11 depicts an embodiment of the present invention where lid 110''' is comprised of panels 250–259 which fold to form one piece which is attached to only one panel 66 of outer portion 60. Lid 110''' of FIG. 11 comprises panels 250, 251, 252, 253, 254, 255, 256, 257, 258 and 259, which fold to form one piece and which is attached to only one panel 66 of outer portion 60. FIG. 12 illustrates an embodiment of the present invention where lid 110'''' is formed from multiple panels 211–216, attached to outer portion 60, and where panels 213*b* and 216*b* extend to the interior of the container and provide a barrier to separate the contents of the container.

Figure 14:
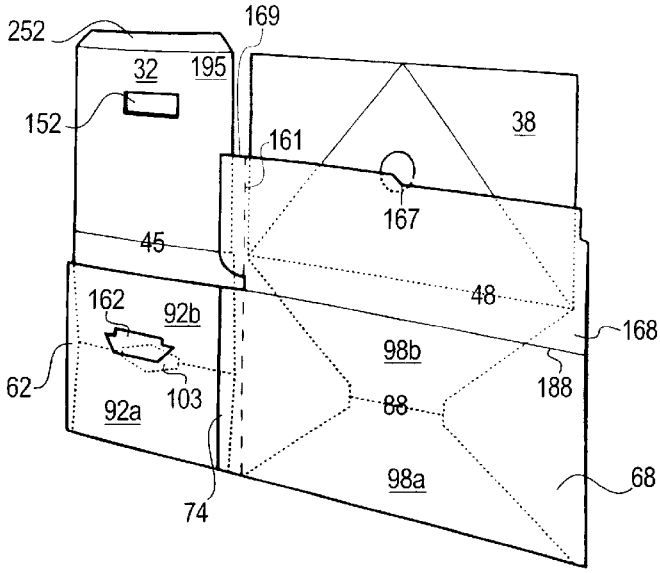
FIG. 14 shows a container formed from the sheet of FIG. 13, after the container has been fully manufactured, folded flat, and is ready for shipment to the user.
Figure 15:
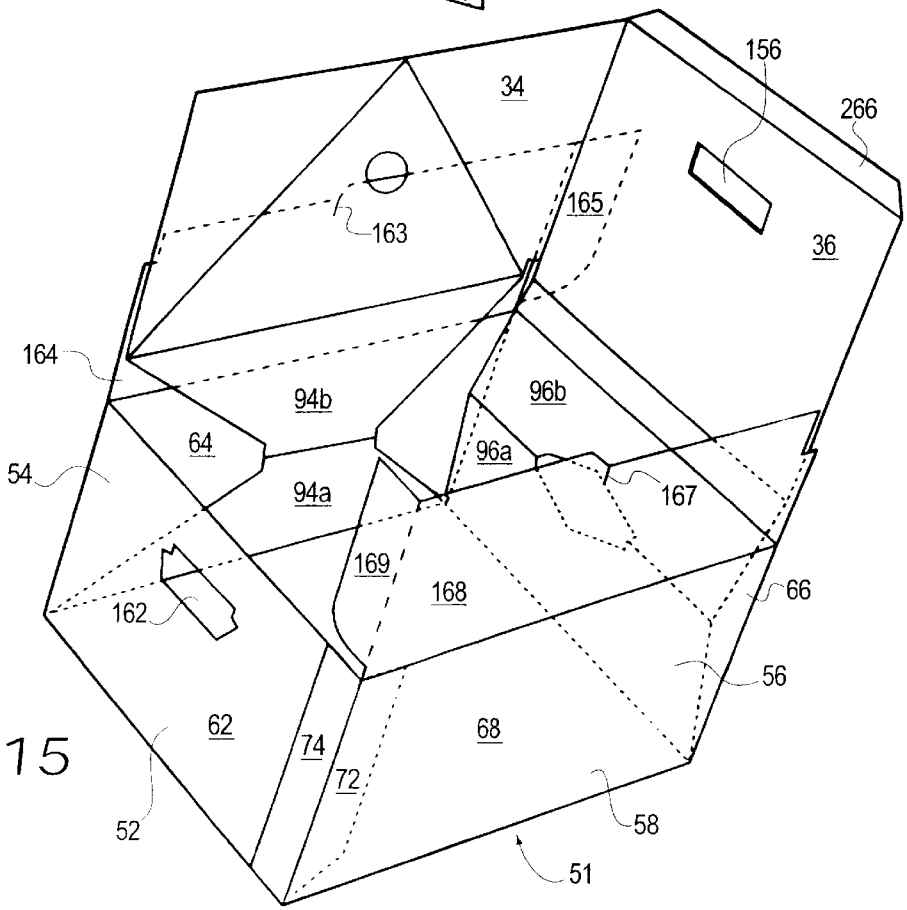
FIG. 15 shows a cutaway view of the container of FIG. 14 after the user has squared the container but before the container is telescoped to full set up.
Figure 16:
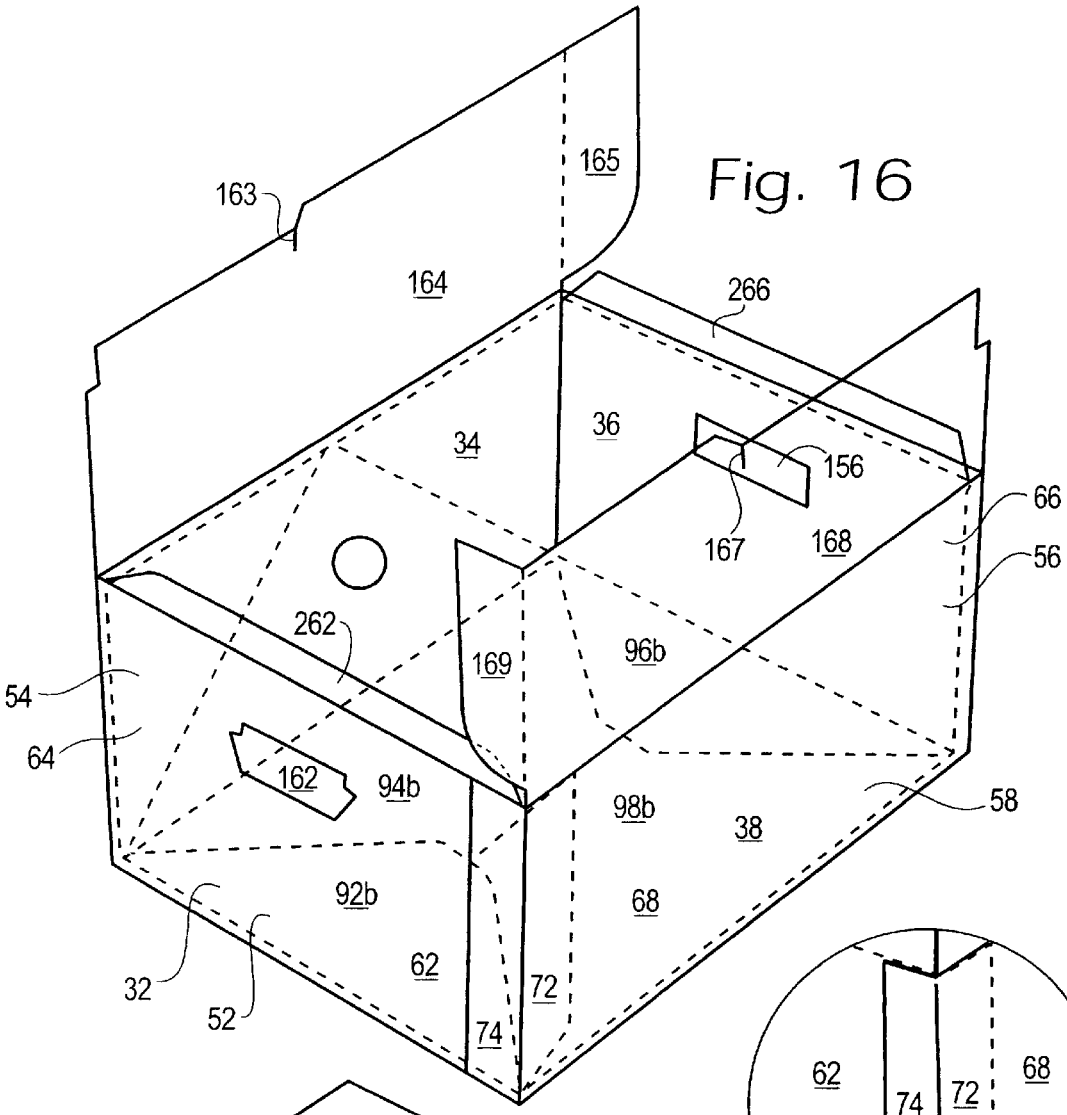
FIG. 16 shows the container of FIG. 14 after the inner portion is telescoped into the outer portion but before the lid is closed.
Figure 16A:
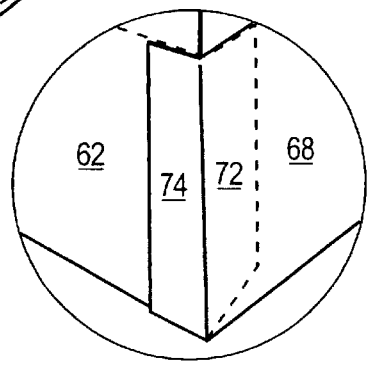
Figure 18:
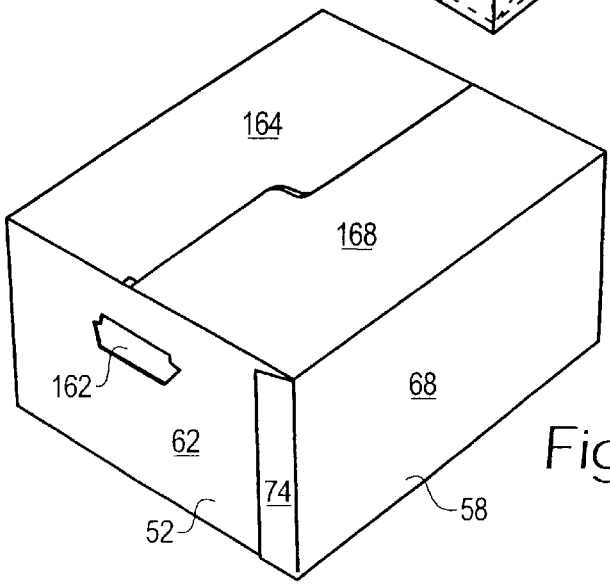
FIG. 18 shows the container of FIG. 14 with the lid closed.
Figure 17:
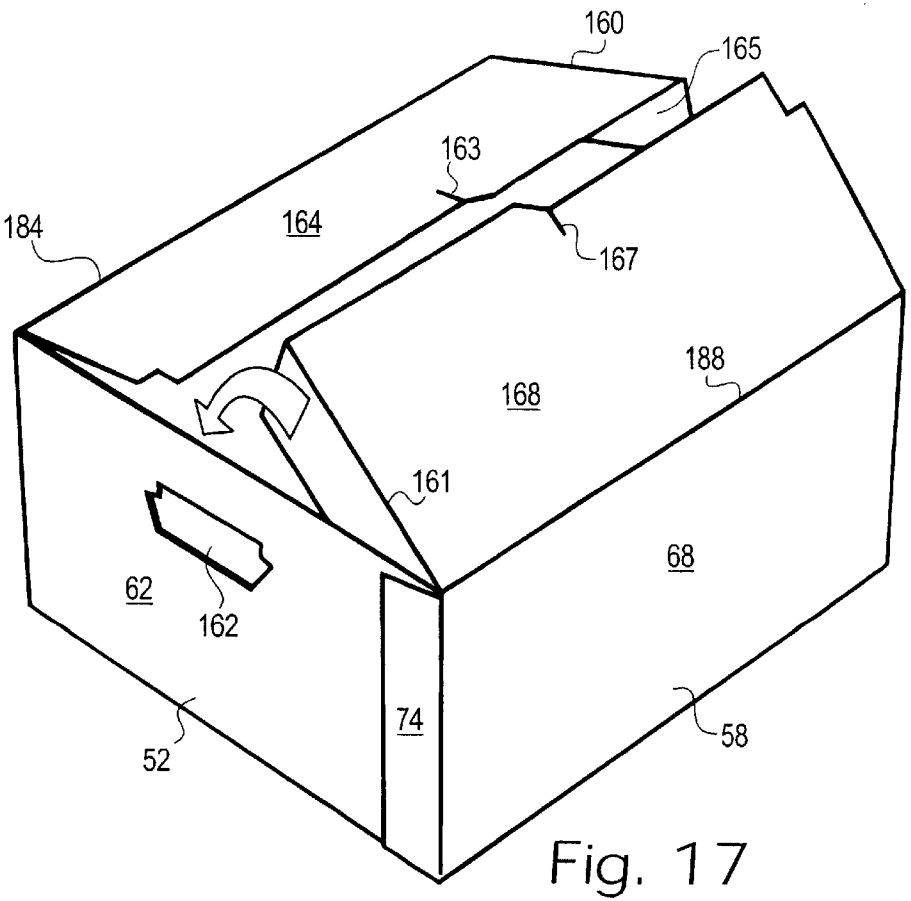
FIG. 17 shows the container of FIG. 14 as the lid is being closed.
Figure 17A:
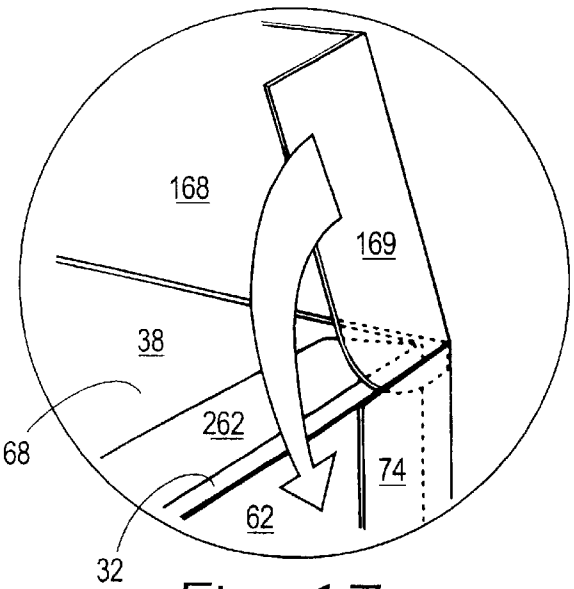

FIGS. 13–18 depict an embodiment of a sheet of material used to form a container according to the present invention where lid 110''''' is formed from two main interlocking flaps 164 and 168 and two smaller side flaps 262 and 266. FIG. 14 shows the container formed from the sheet of FIG. 13 after the container is fully manufactured, folded flat, and is ready for shipment to the user. FIG. 15 shows a cutaway view of the container of FIG. 14 after the user has squared the container but before the container is telescoped to full set up. FIG. 16 shows the container of FIG. 14 after inner portion 30 is telescoped into outer portion 60 but before lid 110''''' is closed. FIG. 17 shows lid 110''''' of the container of FIG. 14 being closed. FIG. 18 shows the container of FIG. 14 with lid 110''''' closed.

The operation of the container of the embodiment depicted in FIGS. 13–18 is substantially similar to that of the embodiment depicted in FIGS. 1–8, but for the structure and operation of lid 110'''''. Lid 110''''' of the embodiment of FIGS. 13–18 is comprised of two main interlocking flaps 164 and 168 attached to panels 64 and 68, respectively, of outer portion 60 and two side flaps 262 and 266 attached to panels 32 and 36, respectively, of inner portion 30. The closure of lid 110''''' of the embodiment of FIGS. 13–18 is described with respect to FIGS. 13 and 17. Interlocking flaps 164 and 168 fold inward towards each other along score lines 184 and 188, respectively. Flap 165, connected to flap 164 at score line 160, is folded to be coplanar with side 56. As flap 164 folds inward flap 165 slides into the space created between panels 36 and 66. Similarly, flap 169, connected to flap 168 at score line 161, is folded to be coplanar with side 52. As flap 168 folds inward flap 169 slides into the space created between panels 32 and 62. Flaps 165 and 169 increase the rigidity of the container and hold flaps 164 and 168 in position. Flap 262, connected to panel 32, folds inward at score line 195 to lie underneath flaps 164 and 168. Similarly, flap 266, connected to panel 36, folds inward at score line 199. Flaps 262 and 266 provide non-abrasive surfaces for the user to press down on while telescoping inner portion 30 into outer portion 60, provide hand holds for the user to grip while collapsing container 1, provide structural stability by keeping sides 54 and 58 at right angles to sides 52 and 56 and by providing support for panels 164 and 168, and provide a guide for flaps 165 and 169 when entering into the spaces between the panels of sides 52 and 56. Prior art containers without the non-abrasive surfaces of flaps 262 and 266 required users to press down on a sharp, abrasive surface to assemble the container; alternately, to avoid the sharp edge, the user would flip the container upside down and assemble the container by pressing down on the bottom. As flaps 164 and 168 join, slits 163 and 167 allow flaps 164 and 168 to interlock and thus keep lid 110''''' closed.

In the embodiment of FIGS. 13–18 lid 110''''' extends from outer portion 60 and thus acts to hold inner portion 30 in position and to strengthen the overall structure of the container. In this embodiment lid 110''''' further strengthens the container as flaps 165, 169, 262 and 266 help maintain the rigidity of the container. Furthermore, in this embodiment lid 110''''' closes without entering the cubic volume of the container and thus reducing the storage space available.

III. Supports for Hanging Files

Figure 19:
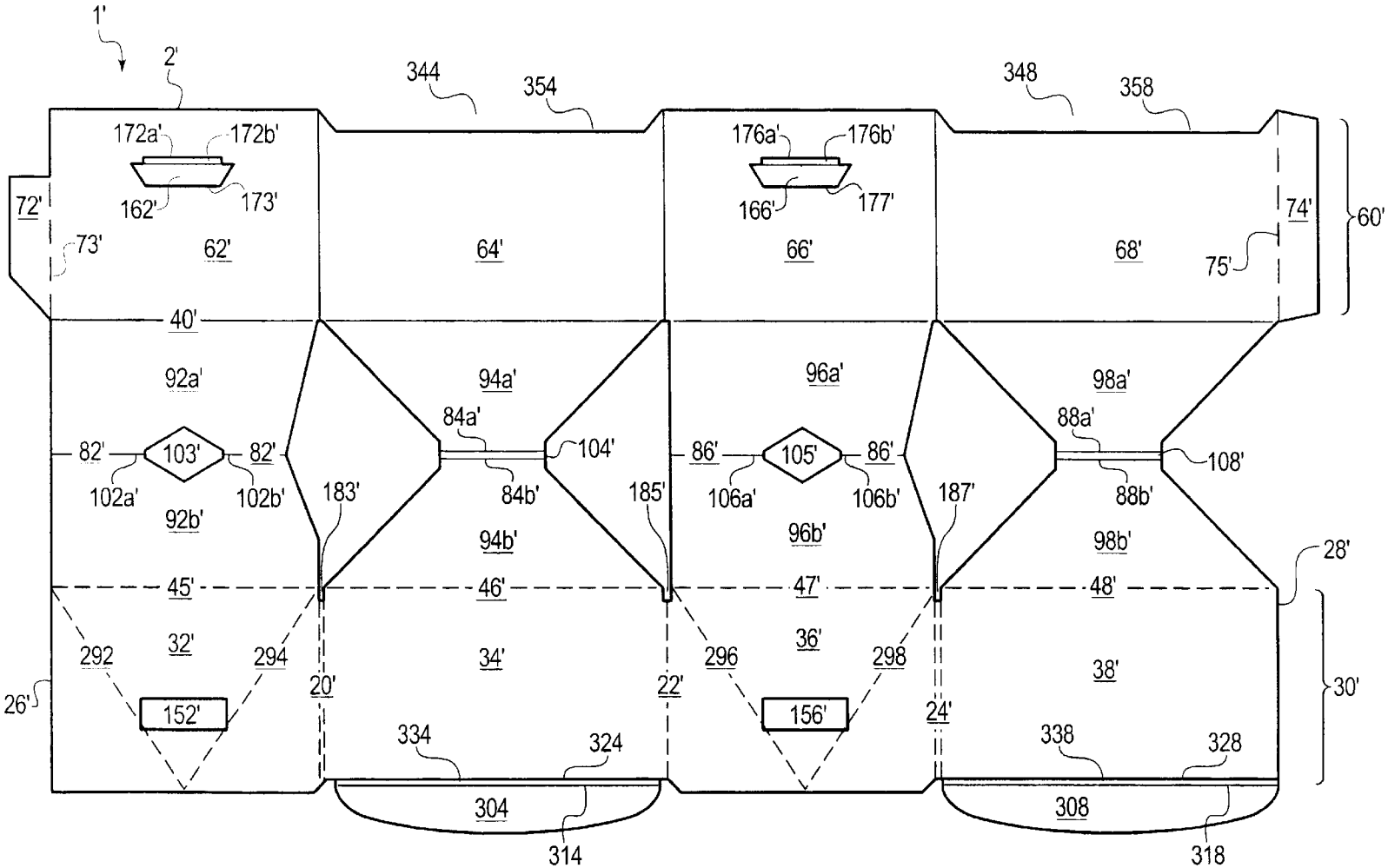
FIG. 19 shows an embodiment of a sheet of material used to form a container according to the present invention which allows for the storage of hanging files, after the sheet of material has been cut from stock material, but before the cut material is folded and glued and ready for shipping.

FIG. 19 shows an embodiment of a sheet of material used to form a container according to the present invention which allows for the storage of hanging files, after the sheet of material has been cut from stock material, but before the cut material is folded and glued and ready for shipping. Referring to FIG. 19, a self assembling container according to an embodiment of the invention, which enables the storage of hanging files, is formed from an integral sheet of material 1'. Sheet 1' is preferably corrugated cardboard or chipboard and is cut using known methods to form cut sheet 2'. The container enables the storage of hanging files with no additional equipment or pieces, such as hanging file inserts or separate rails or supports. Since, in some embodiments, the support areas (which may be termed support portions or support edges) in contact with the hanging files are formed from the side of the material forming the container rather than from a cut edge of the material forming container, they provide a smooth and strong surface, allowing the hooks of the hanging files to slide and allowing for files to be easily inserted in and removed from the container. Since the upwardly extending support panels, supporting the support areas, extend from and are supported by the floor of the container, the strength of the support structures is increased. In one embodiment the upwardly extending support panels have no score lines, and thus have further increased strength. Since the support structures hug the sides of the container, the contents of the folders are prevented from slipping out of the folders. Alternate embodiments may have support structures which are located elsewhere in the container.

The container of FIG. 19 is manufactured, assembled and used in a substantially similar manner to the container of FIG. 1, with the exception that the container of FIG. 19 provides structures allowing for the storage of hanging files, and, in some embodiments, lacks a lid. Thus the components of the container of FIG. 19 are structured substantially similarly and perform substantially the same function as the components of the container of FIG. 1 which, except for the lack of the prime (') symbol, are numbered similarly. For example, sheet 2' is folded along score lines 40', 20' and 24', and edges 26' and 28' are coupled by fastening tab 72' to side panel 68' and fastening tab 74' to side panel 62'. Rather than having score lines 192, 194, 196 and 198 on panels 34 and 38, as in FIG. 1, the container of FIG. 19 has score lines 292 and 294 on panel 32' and score lines 296 and 298 on panel 36'. Score lines 292, 294, 296 and 298, enable side panels 32' and 36' to compress slightly during assembly.

Figure 20:
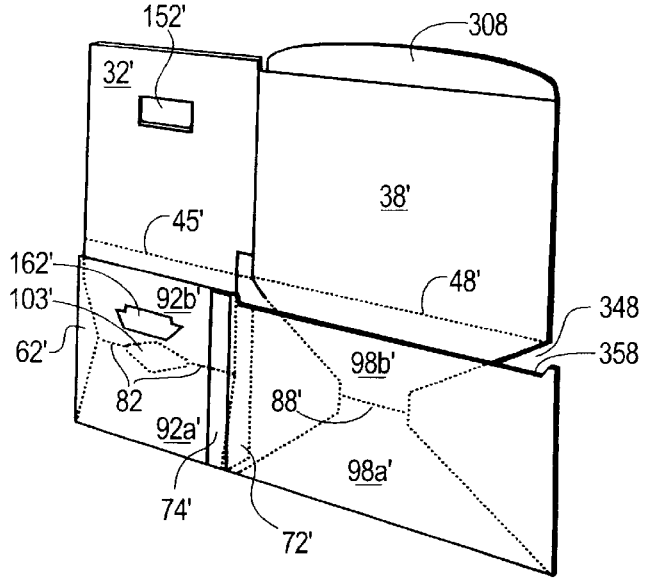
FIG. 20 shows a container formed from the sheet of FIG. 19, after the container has been fully manufactured, folded flat, and is ready for shipment to the user.

FIG. 20 shows a container formed from sheet 2' of FIG. 19, after the container has been fully manufactured, folded flat, and is ready for shipment to the user. The container as shown in FIG. 20 is shipped to the user and stored in a flat form; after the container is set up, it may be knocked down to its flat form. To form the manufactured but not fully assembled container of FIG. 20, sheet 2' is folded along score lines 40', 20' and 24'. Edges 26' and 28' are coupled by fastening tab 72' to the portion of side panel 68' near edge 28' and fastening tab 74' to the portion of side panel 62' near edge 26', as with the container of FIG. 2. Tabs 72' and 74' are fastened to panels 68' and 62' by glue, but may be attached by other methods. Alternatively, only one of tabs 72' and 74' may be glued. In another embodiment of the present invention edges 26' and 28' may be coupled by a method other than by two tabs.

Referring to FIG. 19, when the container is fully assembled horizontal support portion 338 (defined by score lines 318 and 328) and horizontal support portion 334 (defined by score lines 314 and 324) may support hanging files. Downwardly extending flaps 304 and 308 fold down to help form and define horizontal support portions 334 and 338. Cut out portion 344 (defined by edge 354) and cut out portion 348 (defined by edge 358) allow for hanging files to be placed into the container with greater ease. The horizontal support portions 334 and 338 are recessed from the top of the container, allowing room for the hooks of the hanging files as well as for the tabs holding file labels to extend from the top of hanging files stored in the container. Panels 34' and 38' form upwardly extending support panels 34' and 38'. Horizontal support portions 334 and 338 are formed by and reinforced by the folding of downwardly extending flaps 304 and 308, which are compressed against upwardly extending support panels 34' and 38', respectively, as panels 34' and 38' are pushed against the sides of the container.

In an alternate embodiment downwardly extending flaps 304 and 308 may be of a different size and shape than as depicted in FIG. 19. For example the downwardly extending flaps aiding the formation of the support structures may be similar in size to the side panels of the container, or may be composed of more than one panel each. In alternate embodiments downwardly extending flaps 304 and 308 may fold towards the inner portion of the container, or may be attached to panels of outer portion 60' rather than inner portion 30'.

As shown with respect to FIG. 19, tab 162' is formed from perforation 173', and folds inward along score lines 172*a*' and 172*b*', through hand hole 152' to connect panel 62' to panel 32' and to maintain the form of the container. In like manner tab 166' is formed from perforation 177', and folds inward along score lines 176*a*' and 176*b*', through hand hole 156'.

Figure 25:
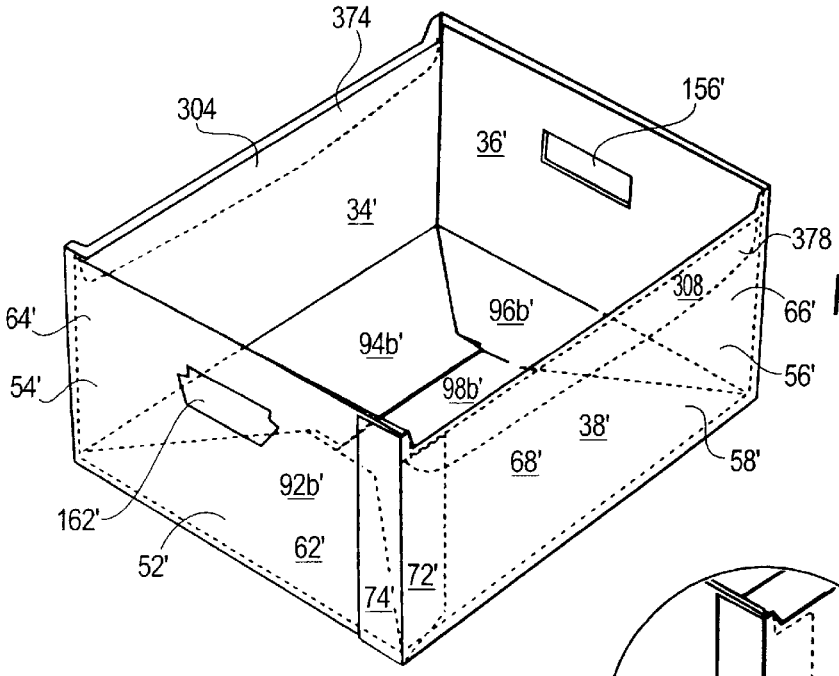
FIG. 25 shows the container of FIG. 20, after the inner portion has been telescoped into the outer portion.
Figure 25A:
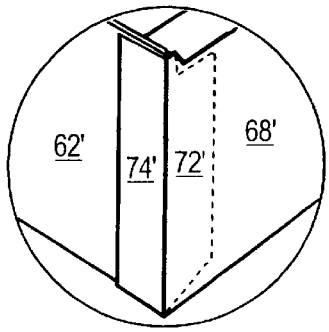
Figure 21:
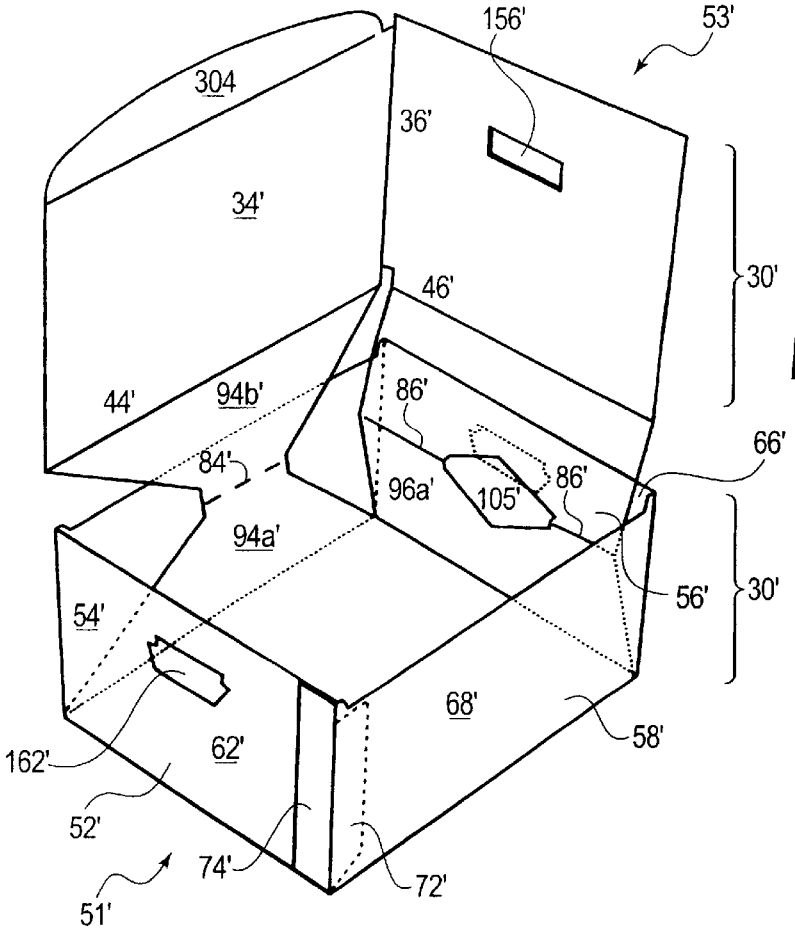
FIG. 21 shows a cutaway view of the container of FIG. 20 after the user has squared the box but before the box is telescoped to full set up.
Figure 22:
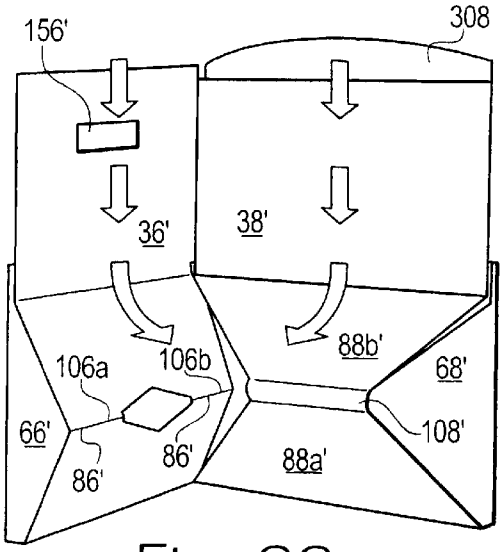
FIG. 22 shows a cutaway view of the container of FIG. 20 with the inner portion being telescoped into the outer portion.
Figure 23:
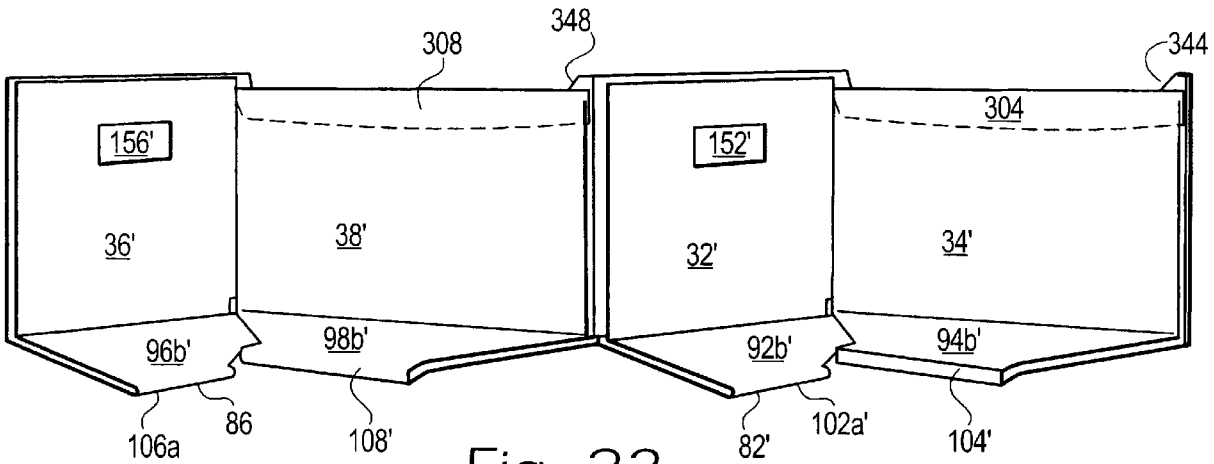
FIG. 23 shows a cutaway view of the container of FIG. 20 after the inner portion has been telescoped into the outer portion, shown opened to reveal the configuration of the panels of the container.
Figure 26:
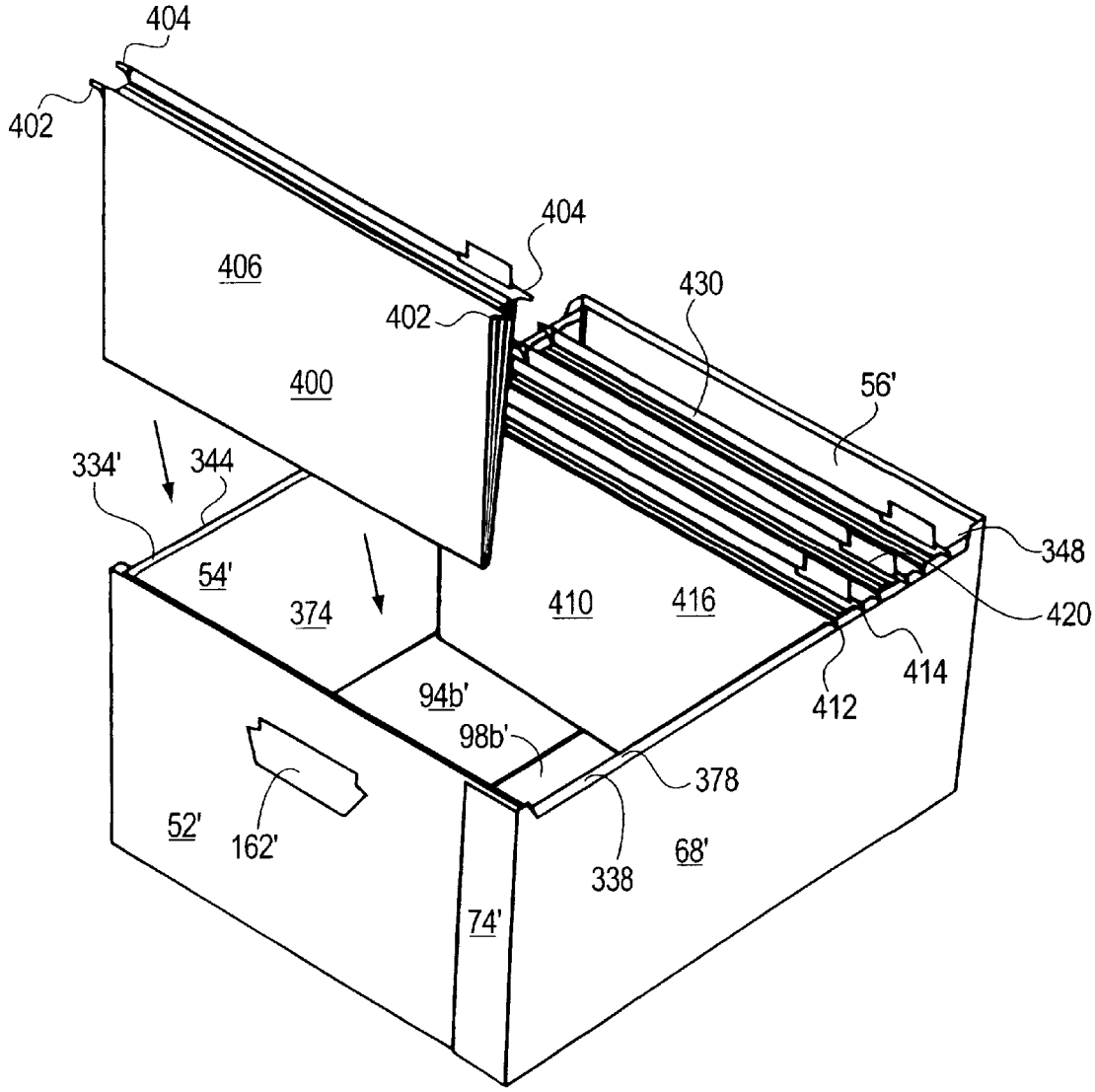
FIG. 26 shows the container of FIG. 20, after the inner portion has been telescoped into the outer portion, with hanging files positioned inside the container and a hanging file being inserted.

Set up of a container for storing hanging files from the collapsed flat condition as depicted in FIG. 20 into the fully erected container of FIGS. 25 and 26 is depicted in FIGS. 21–23. The operation of the container of the embodiment depicted in FIGS. 19–27 is substantially similar to that of the embodiment depicted in FIGS. 1–4, but for the structure and operation of components used to facilitate the storage of hanging files, and that lid 110 is not present in the embodiment depicted in FIGS. 19–27.

To set up the flat manufactured container of FIG. 20, the user expands the container into a rectangular parallelepiped box. Sides 52', 54', 56' and 58' pivot along score lines 73', 20', 22', 24' and 75'. FIG. 21 shows a cutaway view of the container of FIG. 20 after the user has squared the box but before the box is telescoped to full set up. With reference to FIG. 21, the box has four elongated rectangular sides 52', 54', 56' and 58' and two open ends 51' and 53'. Inner portion 30', comprised of panels 32', 34', 36' and 38', may telescope into outer portion 60', comprised of panels 62', 64', 66' and 68'. Panels 92*a*', 92*b*', 94*a*', 94*b*', 96*a*', 96*b*', 98*a*' and 98*b*' may join to form the bottom.

FIG. 22 shows a cutaway view of the container of FIG. 20 with the inner portion being telescoped into the outer portion. As shown with respect to FIG. 22, the user further sets up the box by pressing down on inner portion 30'. The user grasps downwardly extending flaps 304 and 308, folding them outward, and presses down on horizontal support portions 334 and 338 and thus on inner portion 30'. As the user presses down on inner portion 30', the container assembles as with the container of FIGS. 3–7. In one fluid motion the user may form a box with reinforced support structures capable of holding hanging files. Smooth horizontal support portions 334 and 338 allow the user to set up the container without pressing on the sharp, abrasive surfaces which are part of prior art containers, and without having to flip the container upside down to avoid the abrasive edge. Downwardly extending flaps 304 and 308 (FIG. 19) slide between inner portion 30' and outer portion 60'. When the user presses down on inner portion 30', bottom panels 92*a*', 92*b*', 94*a*', 94*b*', 96*a*', 96*b*', 98*a*' and 98*b*' fold along respective score lines 82', 84', 86'and 88', respective score lines 45', 46', 47' and 48'and score line 40'. In one embodiment, score line 88' is composed of score lines 88*a*' and 88*b*', and score line 84' is composed of score lines 84*a*' and 84*b*'. Gaps 183', 185' and 187' allow the lower portion of the inner portion 30' to compress. Score lines 292, 294, 296 and 298 enable side panels 32' and 36' to compress slightly. To form the bottom, edge 102*a*' and edge 106*b*' slide between bottom panels 98*a*' and 98*b*'. In like manner, edges 102*b*' and 106*a*' slide between bottom panels 94*a*' and 94*b*'. Edges 104' and 108' are formed and meet in the region formed by cut-out areas 103' and 105'.

Figure 24:
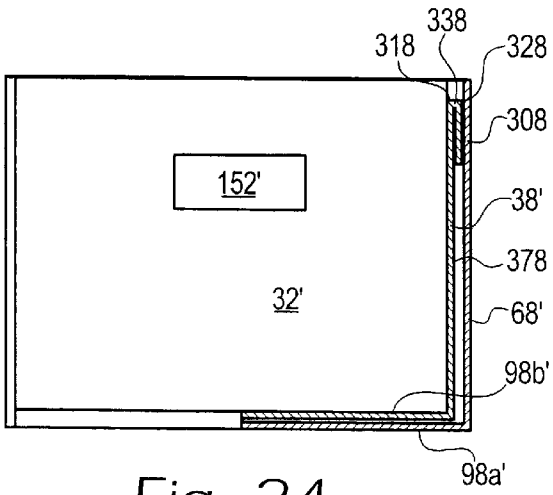
FIG. 24 shows a side cutaway view of the container of FIG. 20 after the inner portion has been telescoped into the outer portion, depicting in particular one support structure for hanging files.

After the above described set up by the user, the container is formed, as shown in FIGS. 25 and 26, as a rectangular parallelepiped box with an open top. FIG. 23 shows a cutaway view of the container of FIG. 20 after the inner portion has been telescoped into the outer portion, shown opened to reveal the configuration of the panels of the container. FIG. 24 shows a side cutaway view of the container of FIG. 20 after the inner portion has been telescoped into the outer portion, depicting in particular one support structure for hanging files. Referring to FIG. 24, support structure 378 includes horizontal support portion 338 (defined by score lines 318 and 328), upwardly extending support panel 38', and downwardly extending flaps 308. Support structure 374 includes horizontal support portion 334 (defined by score lines 314 and 324), upwardly extending support panel 34', and downwardly extending flaps 304. Horizontal support portion 338 is defined by and reinforced by score lines 318 and 328, and reinforced by downwardly extending flap 308 and upwardly extending support panel 38'. FIG. 25 shows the container of FIG. 20, after the inner portion has been telescoped into the outer portion as a rectangular parallelepiped box with an open top.

When the container of FIGS. 19–27 is fully assembled, downwardly extending flaps 304 and 308 are folded outward and lie between panels 34', 38', 64' and 68' of the inner and outer portions; downwardly extending flap 304 lies between upwardly extending support panel 34' and panel 64', and downwardly extending flap 308 lies between upwardly extending support panel 38' and panel 68'. Horizontal support portions 334 and 338 are held flat and parallel with the bottom of the container by having downwardly extending flaps 304 and 308 fold outward to a position parallel with sides 54' and 58' of the container. In an alternate embodiment, instead of having a horizontal support portion formed from two score lines, a support edge, coming in contact with and supporting hanging files, may be formed using one score line. In alternate embodiments each of the sides of the box, rather than two opposing sides, may have support structures.

The collapsible box of FIGS. 19–27 may be used with support structures having structures other than that shown. For example, flaps aiding in the formation of support structures may extend directly from the outer side of the box, rather than from a panel extending from the floor of the box. In such an embodiment, each flap, being smaller than or substantially equal in size to the side to which it is attached, extends from the upper end of that side. After the flap is folded down it provides a smooth reinforced support for hanging files. The flap may be secured to the side of the box by, for example, glueing of stapling, or by being located between two side panels.

Horizontal support portions 334 and 338 provide a smooth, reinforced surface on which the hooks of hanging files may rest. Horizontal support portions 334 and 338 are reinforced by being formed by and by extending between two panels each (e.g., horizontal support portion 334 is supported by and extends between upwardly extending support panel 34' and downwardly extending flap 304 and horizontal support portion 338 is supported by and extends between upwardly extending support panel 38' and downwardly extending flap 308); horizontal support portions 334 and 338 are also reinforced in that they are formed from a strip of material supported by two folds. Since horizontal support portions 334 and 338 are formed from the smooth side of material 1' forming the container, rather than from a cut edge of material 1', horizontal support portions 334 and 338 provide a smooth and strong surface allowing hooks to slide along horizontal support portions 334 and 338 and allowing for hanging files to be easily inserted in and removed from the container. Since horizontal support portions 334 and 338 are formed from a strip of material 1' supported by two panels of material 1', horizontal support portions 334 and 338 are wider than if formed of one cut edge of material. Of course, if such advantages are not desired, the lone cut edge may be used, omitting downwardly extending flaps 304 and 308.

The benefits of strength, smoothness, and support are achieved without the requirement of a separate piece, and without the requirement of a type of material that differs from that of material 1' (e.g., plastic or metal vs. cardboard). The improved support structure of the present invention may be used with containers other than nested boxes. For example the improved support structure may be used with a single walled pre-assembled box; if desired, the flaps forming the support structures may be fastened to the sides of the box using, for example, glue or stapling. In an alternate embodiment the support structures may be reinforced by material integral to the box; for example a plastic laminate, or another coating such as a water based coating, may be added to the area of the horizontal support portions.

FIG. 26 shows the container formed of FIG. 20, after the inner portion has been telescoped into the outer portion, with hanging files 410, 420 and 430 positioned inside the container and hanging file 400 being inserted. Each hanging file has four hooks extending outward from the hanging file; for example hanging file 400 has hooks 402 and 404 and hanging file 410 has hooks 412 and 414. Hooks may be, for example, metal or plastic, or any other material with the requisite strength, and the bodies of hanging files 400–430 may be any flexible material, such as stiff paper or plastic. For clarity, only the hooks 402, 404, 410 and 414 and bodies 406 and 416 for hanging files 400 and 410 are labeled. The body of each hanging file hangs down from the top portion of each hanging file, which is supported by the set of hooks. Each set of hooks rests on horizontal support portions 334 and 338. While the embodiments depicted in FIGS. 19–33 are well suited to the storage of hanging files, any material or objects may be stored in the containers of these embodiments.

Figure 27:
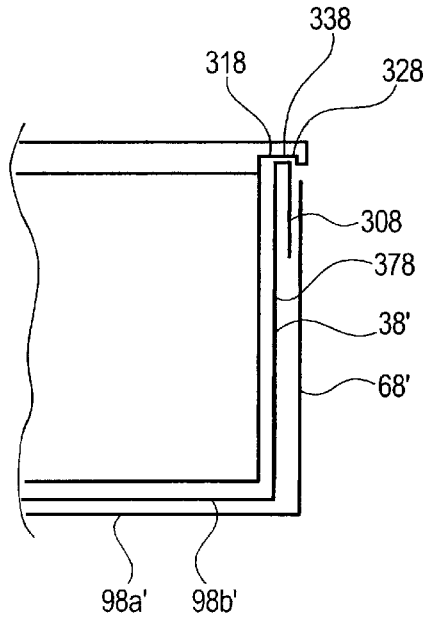
FIG. 27 shows a side cutaway view of the container of FIG. 20, after the inner portion has been telescoped into the outer portion, with a file having a hook with a downward extending tip being supported by the container.

FIG. 27 shows a side cutaway view of the container of FIG. 20, after the inner portion has been telescoped into the outer portion, with a file having a hook with a downward extending tip being supported by the container. If a hanging file having a hook with a downward extending tip as shown in FIG. 27 is used with the container, the smooth horizontal support portion (e.g., horizontal support portion 338), provided in part by downwardly extending flaps 304 and 308 folding out, allows for the hook to slide without catching. In a container using support areas formed from cut edges of cardboard or other material which is not as smooth the side of the material, a hook with a downward extending tip may catch.

The container of FIGS. 19–27 may be used with any sort of lid; for example a separate removable lid or a lid which is formed from material integral with or extending from the container. For example, the container of FIGS. 19–27 may be used with the multiple panel lid 110" of FIG. 10. Embodiments of various lids which may be used with the container of FIGS. 19–27 are depicted in FIGS. 28–33; other embodiments may use other lids or may be used without a lid.

Figure 28:
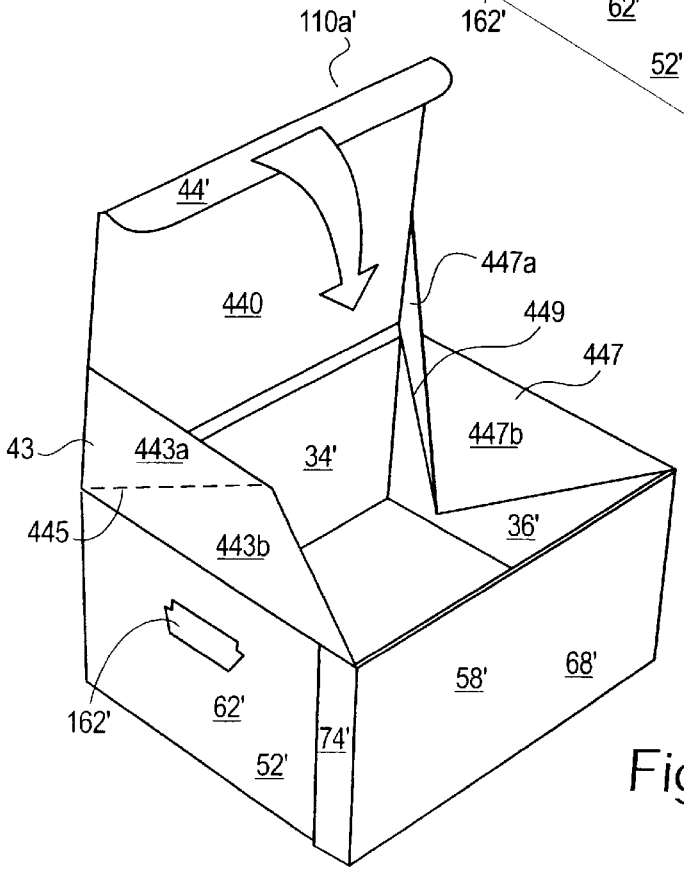
FIG. 28 shows a container according to an embodiment of the present invention which may hold hanging files, where the lid is formed from multiple panels extending from the container, after the inner portion is telescoped into the outer portion but before the lid is closed.

FIG. 28 shows a container according to an embodiment of the present invention which may hold hanging files, where the lid is formed from multiple panels extending from the container, after the inner portion is telescoped into the outer portion but before the lid is closed. In this embodiment, lid 110*a'* is formed from panels 440, 443 and 447, and flap 441, which comprise one continuous sheet of material extending from outer portion 60'. After assembling the container by pressing inner portion 30' into outer portion 60', the user folds panels 443 and 447 inward, allowing panel 440 and flap 441 to close the container. Score line 445 allows panel section 443 to fold inward; panel section 443*a* rests on top of panel section 443*b*. In like manner, score line 449 allows panel sections 447*a* and 447*b* to fold inward; panel sections 447*a* rests on top of panel section 447*b*. To secure lid 110*a'* in a closed position, flap 441 enters the space between inner portion 30' and outer portion 60' defined by panels 38' and 68'. In such an embodiment, and with other embodiments having support structures and a lid, cut out portions 344 and 348 may be omitted.

Figure 29B:
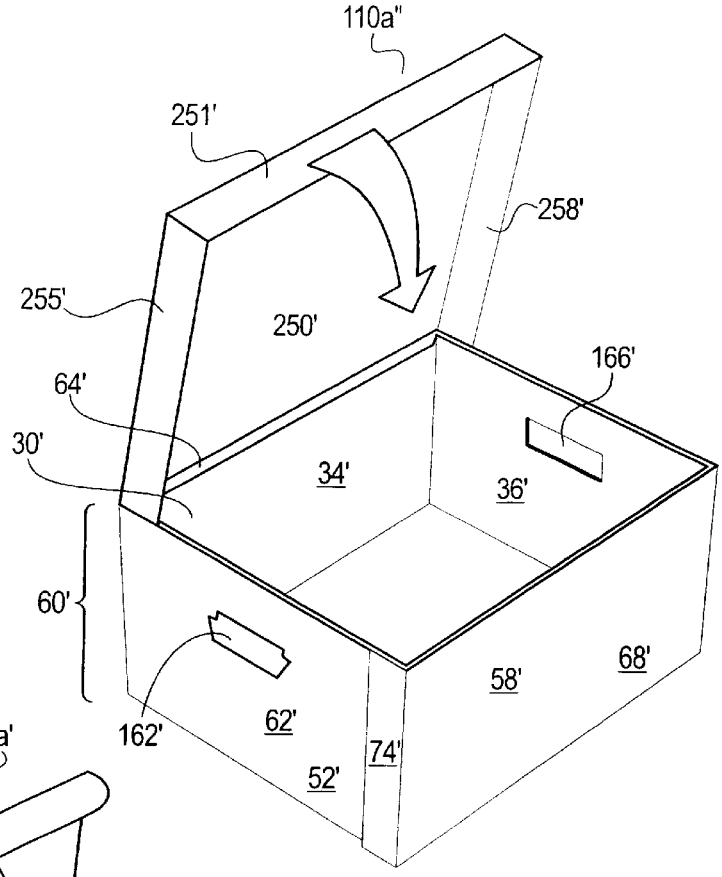
FIG. 29*b* depicts a container according to an embodiment of the present invention including the one piece lid of FIG. 29*b,* after the lid and container are assembled and after the inner portion is telescoped into the outer portion, but before the lid is closed.
Figure 29A:
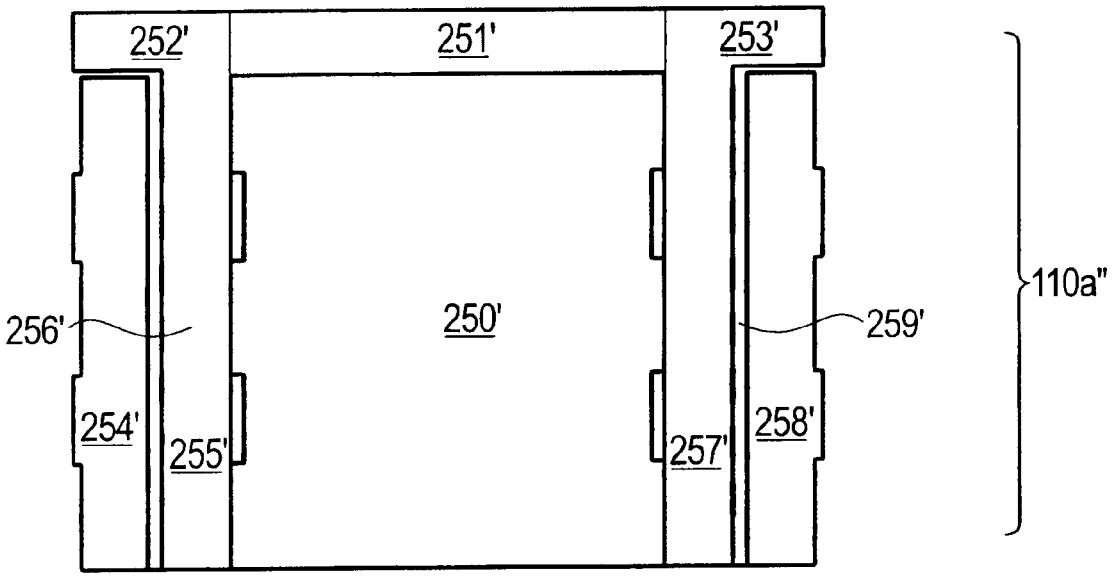
FIG. 29*a* depicts a one piece lid in its unassembled form, formed from the same sheet as a container according to an embodiment of the present invention, but depicted separately from such a container.

FIGS. 29*a* and 29*b* depict an embodiment of the present invention where lid 110*a*" is comprised of multiple panels integral with the container. FIG. 29*a* depicts a one piece lid in its unassembled form, formed from the same sheet as a container according to an embodiment of the present invention, but depicted separately from such a container. Referring to FIG. 29*a,* lid 110*a*" is comprised of panels 250', 251', 252', 253', 254', 255', 256', 257', 258' and 259', which fold to form one piece and which is attached to only one panel 64' (FIG. 29*b*) of outer portion 60' (FIG. 29*b*). FIG. 29*b* depicts a container according to an embodiment of the present invention including one piece lid 110*a*" of FIG. 29*b,* after lid 110*a*" and the container are assembled and after the inner portion is telescoped into the outer portion, but before lid 110*a*" is closed.

Figure 30:
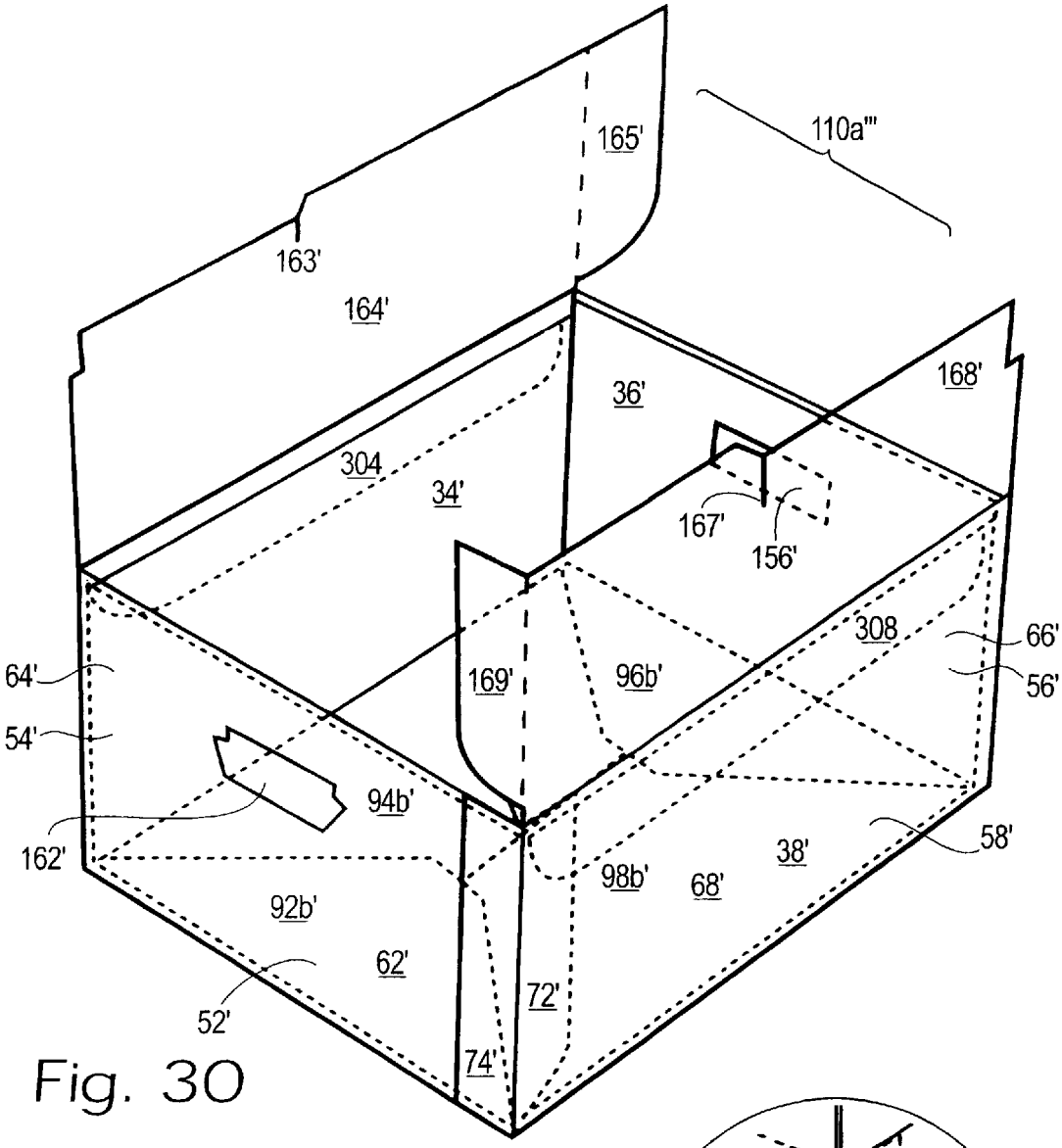
FIG. 30 shows a container of an embodiment of the present invention, having a lid composed of multiple panels, after the inner portion is telescoped into the outer portion but before the lid is closed.
Figure 30A:
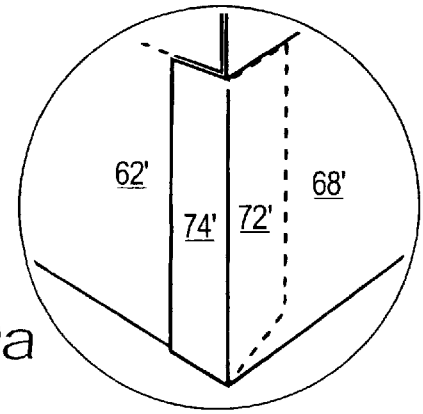

FIGS. 30–33 depict an embodiment of a container according to the present invention capable of holding hanging files where lid 110*a*'" is formed from two main interlocking flaps. The operation of the container of the embodiment depicted in FIGS. 30–33 is substantially similar to that of the embodiment depicted in FIGS. 19–27, but for the structure and operation of lid 110*a*'". Lid 110*a*'" of FIGS. 30–33 has the same structure and operation as lid 110'"" of FIGS. 13–18. FIG. 30 shows a container of an embodiment of the present invention, having a lid composed of multiple panels, after the inner portion is telescoped into the outer portion but before the lid is closed. The container of FIG. 30 is capable of holding hanging files and includes lid 110*a*'", which is formed from main flaps 164' and 168' and smaller side flaps 165' and 169'. Main interlocking flaps 164' and 168' are attached to panels 64' and 68', respectively, of outer portion 60'. Side flaps 165' and 169' are attached to main flaps 164' and 168', respectively. To close lid 110*a*" interlocking flaps 164' and 168' fold inward towards each other along score lines 184' and 188', respectively. As flaps 164' and 168' join, slits 163' and 167' allow flaps 164' and 168' to interlock and thus keep lid 110*a*'" closed.

Figure 31:
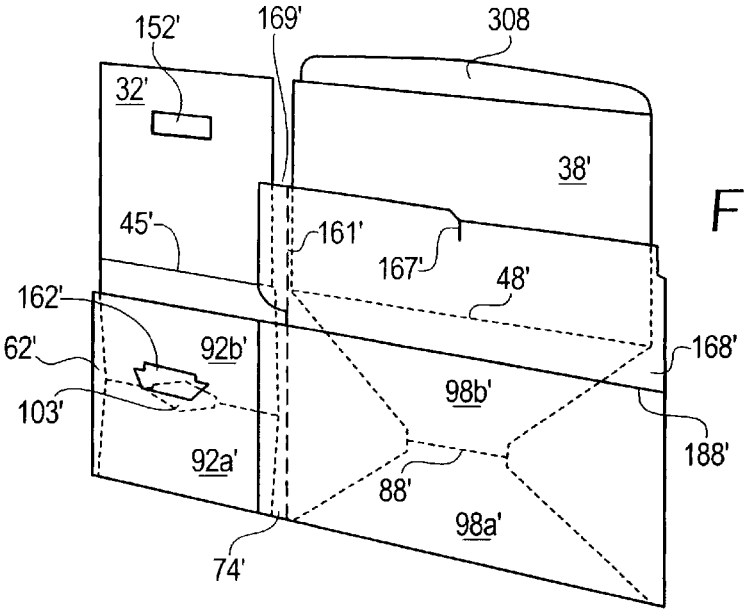
FIG. 31 shows the container of FIG. 30 after the container is fully manufactured, folded flat, and ready for shipment to the user but before being assembled.
Figure 32:
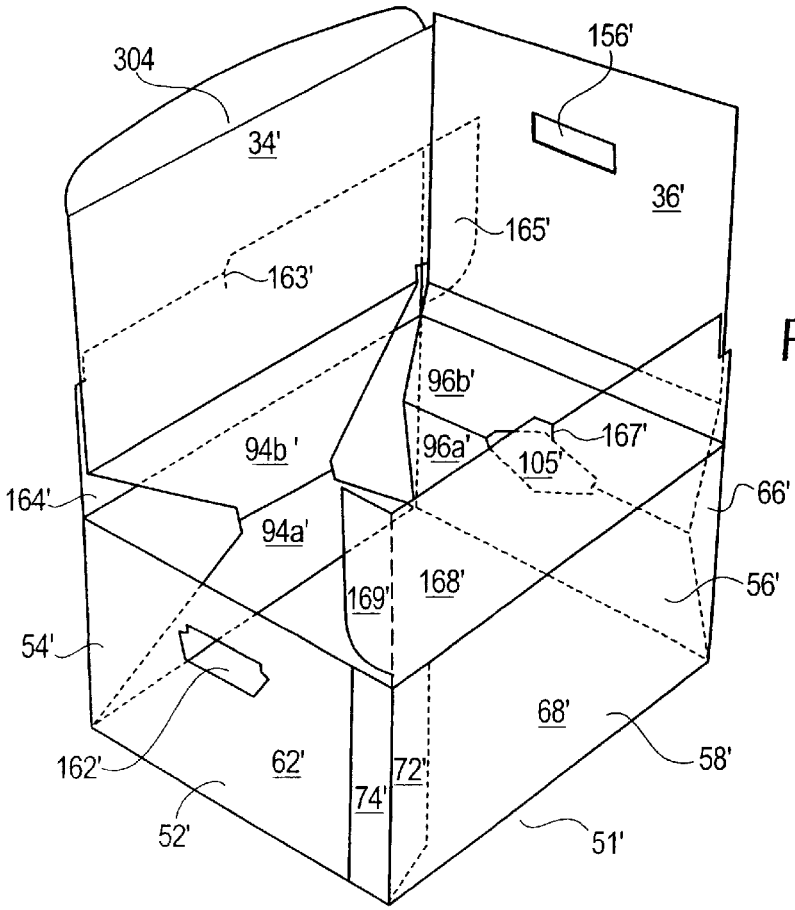
FIG. 32 shows a cutaway view of the container of FIG. 30 after the user has squared the container but before the container is telescoped to full set up.
Figure 33:
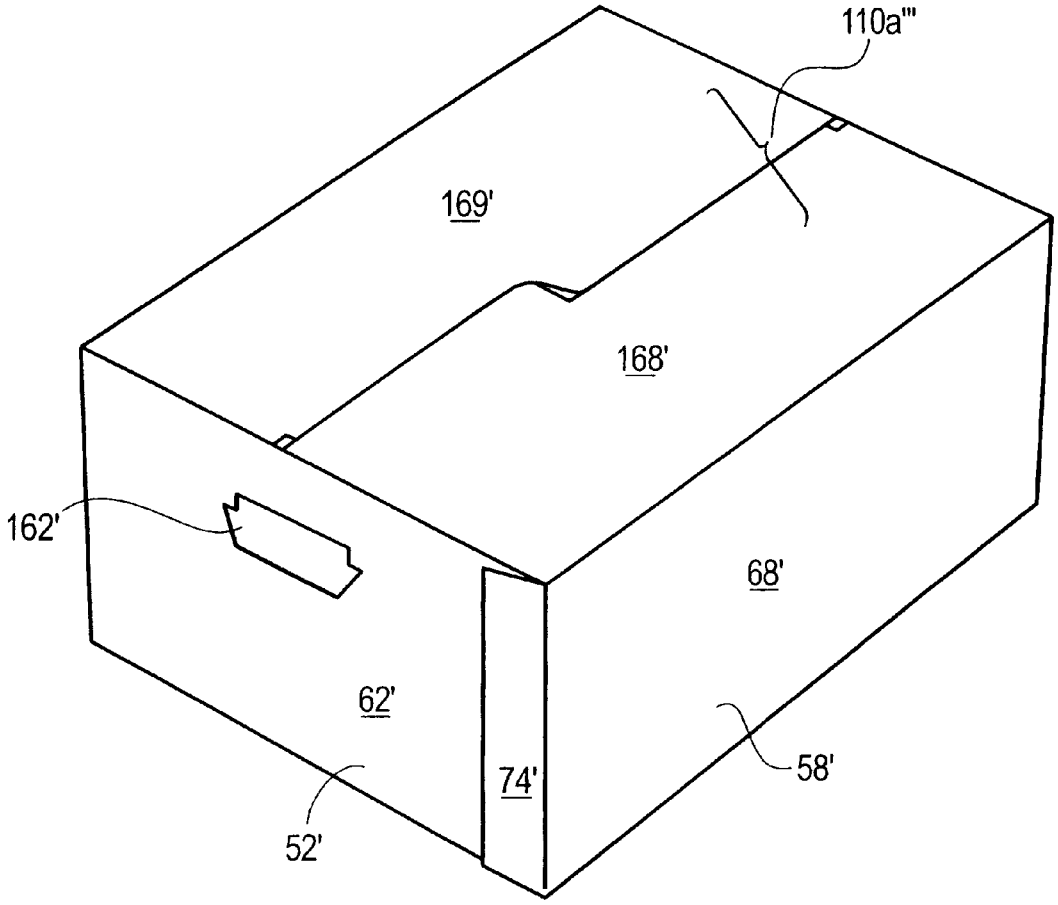
FIG. 33 shows the container of FIG. 30 after the inner portion has been telescoped into the outer portion, with the lid closed.

FIG. 31 shows the container of FIG. 30 after the container is fully manufactured, folded flat, and ready for shipment to the user but before being assembled. FIG. 32 shows a cutaway view of the container of FIG. 30 after the user has squared the container but before the container is telescoped to full set up. FIG. 33 shows the container of FIG. 30 after the inner portion has been telescoped into the outer portion, with lid 110*a*'" closed.

Flaps 165' and 169' of FIGS. 30–32 increase the rigidity of the container and hold flaps 164' and 168' in position. Flaps 262 and 266 (FIGS. 13–17) may be omitted, if it is desired, to maximize the amount of space devoted for hanging files, as flaps 262 and 266 may interfere with available space. In the embodiment of FIGS. 30–33 lid 110*a*'" extends from outer portion 60 and thus acts to hold inner portion 30 in position and to strengthen the overall structure of the container. In this embodiment lid 110*a*'" further strengthens the container as flaps 165' and 169' help maintain the rigidity of the container. Furthermore, in this embodiment lid 110*a*'" closes without entering the cubic volume of the container, which may be occupied by hanging files or other contents.

In alternate embodiments a lid used with the containers of FIGS. 19–33 may extend from inner portion 30' rather than outer portion 60', or from both inner portion 30' and outer portion 60'. The lid may be sealed by a structure similar to that of flap 130 and tabs 132 and 134 (FIG. 1) or by other means such as glueing or stapling. The lid may not completely close off the container.

IV. Summary

While the invention has been described in connection with illustrated embodiments, it is not intended to limit the invention to the particular forms set forth above, but, on the contrary, is intended to cover such alternatives, modifications, and equivalents as may be included within the spirit and scope of the invention as defined by the appended claims.

For example, the materials used to form the container are not limited to corrugated cardboard or chipboard, but may be any foldable material. The container may be formed from one integral piece of material, or may be fabricated from multiple components glued or otherwise attached to act as one piece of material. It may be of a shape other than rectangular, and may have a number of sides other than four. The lid may extend from the inner portion rather than the outer portion, may be comprised of multiple panels, and may be sealed by means such as glueing or stapling. In another embodiment, the lid may not completely close the top end of the container. In yet another embodiment, flaps on the lid may extend to the interior of the container and provide a barrier to separate the contents.

While one embodiment of the container of the present invention provides for an improved support structure in a collapsible container, the improved support structure of the present invention may be used with other, non-collapsible containers as well. The support structure may hold objects other than hanging files. The flaps and panels used to form the improved support structures may differ in form. The improved support structures may be used with a container having any sort of lid, or no lid.

What is claimed is:

1. A collapsible container comprised of:

an inner sleeve portion having a lower end and an upper end and including at least one pair of opposable inner sleeve panels;

an outer sleeve portion having a lower end and an upper end, the inner sleeve portion being snugly nestable within the outer sleeve portion;

a plurality of foldable panels disposed at the respective lower end of each of the inner and outer sleeve portions, the plurality of foldable panels hingeably connecting the inner sleeve portion and the outer sleeve portion, the inner sleeve portion being axially telescopable into the outer sleeve portion to erect the container, and the plurality of foldable panels forming a bottom of the container when the inner sleeve portion is axially telescoped into the outer sleeve portion;

wherein each of the opposable inner sleeve panels in said pair of opposable inner sleeve panels is constructed as an upwardly extending support panel forming a support area at its upper end; and wherein the container further comprises a downwardly extending flap extending from and folding down from the upper end of each of the upwardly extending support panels, wherein the area between the upwardly extending support panel and the downwardly extending flap forms the support area.

2. The container of claim 1 wherein each support area comprises at least a horizontal support portion located between the associated upwardly extending support panel and the associated downwardly extending flap.

3. The container of claim 1 wherein each upwardly extending support panel and associated downwardly extending flap meet at a support edge which comprises the associated support area.

4. The container of claim 1, wherein the support areas may support a set of hanging files.

5. The container of claim 1 wherein the outer sleeve portion includes a pair of opposable outer sleeve panels, each outer sleeve panel in said pair of opposable outer sleeve panels having a cut out portion extending from the upper end of the outer sleeve panel, each cut out portion corresponding to the location of a support area.

6. The container of claim 1 including a lid structure foldably connected to the upper end of the container, the lid structure being closable to form a lid after the inner sleeve portion is axially telescoped into the outer sleeve portion.

7. A collapsible container comprised of:

an inner sleeve portion having a lower end and an upper end and including at least one pair of opposable inner sleeve panels;

an outer sleeve portion having a lower end and an upper end, the inner sleeve portion being snugly nestable within the outer sleeve portion;

a plurality of foldable panels disposed at the respective lower end of each of the inner and outer sleeve portions, the plurality of foldable panels hingeably connecting the inner sleeve portion and the outer sleeve portion, the inner sleeve portion being axially telescopable into the outer sleeve portion to erect the container, and the plurality of foldable panels forming a bottom of the container when the inner sleeve portion is axially telescoped into the outer sleeve portion;

wherein each of the opposable inner sleeve panels in said pair of opposable inner sleeve panels is constructed as an upwardly extending support panel forming a support area at its upper end; and wherein the outer sleeve portion includes a pair of opposable outer sleeve panels, each outer sleeve panel in said pair of opposable outer sleeve panels having a cut out portion extending from the upper end of the outer sleeve panel, each cut out portion corresponding to the location of a support area.

8. The container of claim 7 including a lid structure foldably connected to the upper end of the container, the lid structure being closable to form a lid after the inner sleeve portion is axially telescoped into the outer sleeve portion.

9. The container of claim 7, wherein the support areas may support a set of hanging files.

10. A container having a lower end and an upper end comprised of:

a set of side panels connected together, each side panel having a lower end and an upper end; and a set of support structures, each support structure in the set of support structures attached to one of said side panels, each support structure including at least:

an upwardly extending support panel extending from the lower end of the side panel associated with the support structure; and a downwardly extending flap extending from the upwardly extending support panel wherein each downwardly extending flap is folded to lie between the associated upwardly extending support panel and the associated side panel.

11. The container of claim 10 wherein each support structure further includes at least:

a set of two score lines at the juncture of the associated upwardly extending support panel and the associated downwardly extending flap allowing the flap to fold; and a support area lying between the two score lines.

12. The container of claim 10 wherein the support structures may support a set of hanging files.

13. The container of claim 10 wherein each support structure is constructed from the same piece of material as the container and is integral with the container.

14. The container of claim 10 wherein each upwardly extending support panel lies flat against the side panel associated with the upwardly extending support panel.

15. The container of claim 10 wherein each side panel associated with a support structure includes a cut out portion at the upper end adjacent to the support structure.

16. A container having a lower end and an upper end comprised of:

a set of side panels connected together, each side panel having a lower end and an upper end; and a set of support structures, each support structure in the set of support structures attached to one of said side panels, each support structure including at least:

an upwardly extending support panel extending from the lower end of the side panel associated with the support structure; and a downwardly extending flap extending from the upwardly extending support panel;

wherein each side panel associated with a support structure includes a cut out portion at the upper end adjacent to the support structure.

17. The container of claim 16 wherein each support structure further includes at least:

a set of two score lines at the juncture of the associated upwardly extending support panel and the associated downwardly extending flap allowing the flap to fold; and a support area lying between the two score lines.

18. The container of claim 16 wherein the support structures may support a set of hanging files.

19. The container of claim 16 wherein each support structure is constructed from the same piece of material as the container and is integral with the container.

20. The container of claim 16 wherein each upwardly extending support panel lies flat against the side panel associated with the upwardly extending support panel.

* * * * *

UNITED STATES PATENT AND TRADEMARK OFFICE

CERTIFICATE OF CORRECTION

PATENT NO. : 6,189,776 B1
DATED : February 20, 2001
INVENTOR(S) : Smith et al.

It is certified that error appears in the above-identified patent and that said Letters Patent is hereby corrected as shown below:

Column 2,
Line 55, change "folders. The" to -- folders. (new paragraph)
The --.

Signed and Sealed this

Second Day of November, 2004

JON W. DUDAS
*Director of the United States Patent and Trademark Office*